US009288580B2

(12) United States Patent
Matsumura et al.

(10) Patent No.: US 9,288,580 B2
(45) Date of Patent: Mar. 15, 2016

(54) SPEAKER DEVICE, AUDIO VISUAL EQUIPMENT, MOBILE INFORMATION PROCESSING APPARATUS, VEHICLE, AND EARPHONE

(71) Applicant: Panasonic Corporation, Osaka (JP)

(72) Inventors: Toshiyuki Matsumura, Osaka (JP); Shuji Saiki, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/378,439

(22) PCT Filed: Dec. 19, 2013

(86) PCT No.: PCT/JP2013/007466

§ 371 (c)(1),
(2) Date: Aug. 13, 2014

(87) PCT Pub. No.: WO2014/097632

PCT Pub. Date: Jun. 26, 2014

(65) Prior Publication Data

US 2015/0016660 A1 Jan. 15, 2015

(30) Foreign Application Priority Data

Dec. 20, 2012 (JP) ..... 2012-277795

(51) Int. Cl.
*H04R 1/00* (2006.01)
*H04R 9/02* (2006.01)
(Continued)

(52) U.S. Cl.
CPC ..... *H04R 9/027* (2013.01); *H04R 9/06* (2013.01); *H04R 7/18* (2013.01); *H04R 2499/11* (2013.01)

(58) Field of Classification Search
CPC ..... H04R 9/022; H04R 9/025; H04R 9/027; H04R 2209/024
USPC ..... 381/415
See application file for complete search history.

(56) References Cited

U.S. PATENT DOCUMENTS 4,320,263 A * 3/1982 Thiele ..... H04R 9/027 381/415
6,208,743 B1 * 3/2001 Marten ..... H04R 9/02 381/412

(Continued)

FOREIGN PATENT DOCUMENTS

DE 010207561 C1 * 7/2003 ..... H04R 1/028
JP 55-104894 7/1980

(Continued)

OTHER PUBLICATIONS

International Search Report issued Mar. 18, 2014 in International (PCT) Application No. PCT/JP2013/007466.

*Primary Examiner* — Curtis Kuntz
*Assistant Examiner* — Ryan Robinson
(74) *Attorney, Agent, or Firm* — Wenderoth, Lind & Ponack, L.L.P.

(57) ABSTRACT

A speaker device includes: a magnetic circuit including a plate 1, a magnet 2 having no through-hole, and a yoke 3 forming a magnetic gap; a voice coil 6 disposed in the magnetic gap; a diaphragm 4 directly or indirectly fixed to the voice coil 6; and a magnetic fluid 7 disposed in at least a space between an outer peripheral surface of the voice coil 6 and an inner peripheral surface of the yoke 3. A rear surface side space between a rear surface of the diaphragm 4 and a front surface of the plate 1 communicates with a space outside the speaker device through a gap-for-communication 15 which is formed in at least a part, in a peripheral direction of the voice coil 6, of the space between the outer peripheral surface of the plate 1 and the inner peripheral surface of the voice coil 6.

19 Claims, 15 Drawing Sheets

(51) Int. Cl.
*H04R 9/06* (2006.01)
*H04R 7/18* (2006.01)

(56) References Cited

U.S. PATENT DOCUMENTS

| | | | | |
|---|---|---|---|---|
| 6,868,167 | B2 * | 3/2005 | Tsuda | H04R 31/006 29/594 |
| 7,593,540 | B2 * | 9/2009 | Itakura | H01F 7/066 335/222 |
| 8,615,101 | B2 * | 12/2013 | Zhang | H04R 9/06 381/412 |
| 9,055,359 | B2 * | 6/2015 | Kamimura | H04R 9/025 |
| 2007/0189577 | A1 | 8/2007 | Tsuda et al. | |
| 2011/0044489 | A1 * | 2/2011 | Saiki | H04R 7/20 381/388 |
| 2011/0135138 | A1 * | 6/2011 | Kuze | H04R 9/045 381/398 |
| 2012/0106774 | A1 * | 5/2012 | Saiki | H04R 1/225 381/412 |
| 2013/0237291 | A1 * | 9/2013 | Weber | H04R 7/14 455/569.1 |

FOREIGN PATENT DOCUMENTS

| | | |
|---|---|---|
| JP | 10-126884 | 5/1998 |
| JP | 2005-057640 | 3/2005 |
| JP | 2007-221787 | 8/2007 |
| WO | 2009/066415 | 5/2009 |

* cited by examiner

SPEAKER DEVICE, AUDIO VISUAL EQUIPMENT, MOBILE INFORMATION PROCESSING APPARATUS, VEHICLE, AND EARPHONE

TECHNICAL FIELD

The present invention relates to speaker devices, audio visual equipment including speaker devices, mobile information processing apparatuses including speaker devices, vehicles including speaker devices, earphones including speaker devices, and the like.

BACKGROUND ART

In recent years, downsizing and sophistication of audio visual devices, i.e., so-called AV equipment, are rapidly progressing. Downsizing and sophistication are particularly remarkable in cellular phones, smartphones, tablet PC (personal computer) terminals, and the like. However, since downsizing and sophistication are simultaneously progressing, devices mounted on each equipment are desired to be smaller and thinner. Speaker devices mounted on each equipment are no exception, and are desired to be smaller and thinner like other devices. However, downsizing of a speaker device causes degradation of reproduction performance, particularly, reproduction frequency band or reproduction efficiency, and therefore, conventional techniques have limitations in downsizing and reproduction performance.

As a conventional art, there is a speaker device in which a magnetic fluid is disposed in a magnetic circuit to improve reproduction performance of the speaker device (refer to Patent Literature 1, for example). FIG. 14 shows the conventional speaker device disclosed in Patent Literature 1).

In the speaker device shown in FIG. 14, a voice coil 106 is disposed in a magnetic circuit composed of a plate 101, a magnet 102, and a yoke 103, and a diaphragm 104 is vibrated. A magnetic fluid 107 is disposed between an outer peripheral portion of the plate 101 and an inner peripheral portion of the voice coil 106 to separate a space at a front surface of the diaphragm 104 from a space at a rear surface of the diaphragm 104. Thus, a sound emitted from the front surface of the diaphragm 104 and a sound emitted from the rear surface of the diaphragm 104 are prevented from canceling out each other, and rolling vibration of the diaphragm 104 is prevented, and further, Joule heat generated in the voice coil 106 is caused to escape to the magnetic circuit. In addition, the diaphragm 104 is supported by a plurality of edge pieces 105 in combination with the magnetic fluid 107. Thus, as compared to a case where the entire outer periphery of the diaphragm 104 is supported by a single edge, the compliance of the supporting system supporting the diaphragm 104 is increased, thereby realizing reproduction of a low frequency band in spite of a small diameter.

CITATION LIST

Patent Literature

[PTL 1] International Publication WO2009-066415

SUMMARY OF THE INVENTION

Problems to be Solved by the Invention

In the speaker device configured as described in Patent Literature 1, a sound generated from the rear surface of the diaphragm 104 passes through a hole penetrating through the plate 101, the magnet 102, and the yoke 103, and is emitted from a lower surface of the speaker device. If the hole is not provided, vibration of the diaphragm is suppressed by stiffness of air in a space surrounded by the plate 101, the magnetic fluid 107, the voice coil 106, and the diaphragm 104, and thereby bass reproduction of the speaker device is inhibited.

However, since it is difficult to form a hole through a magnet because of problems in manufacturing, the shape of the magnet is restricted. For example, it is difficult to manufacture a thin or slim magnet. The reason is as follows. When a magnet contracts during sintering, a stress occurs at the periphery of a hole, and causes cracking or the like. For example, a thin magnet is easy to crack because it is weak against a stress. An oval magnet or a magnet having a track shape (a shape composed of two parallel linear segments and two curved segments connecting the linear segments at their opposite ends) is easy to crack because a stress applied to the periphery of a hole is uneven. Therefore, it is difficult to manufacture these magnets. More specifically, it is difficult to stably manufacture a magnet with a hole, having a thickness less than 1 mm, or a rectangular or track-shaped magnet with a hole, having a width less than 5 mm. Therefore, according to Patent Literature 1, it is difficult to realize a thin speaker device or a slim speaker device.

On the other hand, there is a method in which a magnet without a hole is manufactured, and a hole is formed in the magnet in a subsequent process. However, when a hole is formed in a thin or slim magnet, the magnet is likely to crack during a drilling process, and therefore, it is difficult to stably manufacture the magnet. Although it is conceivable that the drilling speed is reduced to avoid cracking, such processing increases the manufacturing cost and degrades the mass productivity.

The present invention is made in view of the above problems, and provides a compact speaker device which facilitates manufacture of a magnet, and enables reproduction in a wide frequency range.

Solution to the Problems

A speaker device according to an aspect of the present invention includes: a magnetic circuit including a plate, a magnet having a surface fixed to one surface of the plate and having no through-hole, and a yoke fixed to a surface of the magnet opposite to the surface fixed to the plate and forming a magnetic gap between itself and an outer peripheral surface of the plate; a voice coil disposed in the magnetic gap; a diaphragm directly or indirectly fixed to the voice coil; a supporting part configured to support the diaphragm; and a magnetic fluid disposed in at least one of a space between the outer peripheral surface of the plate and an inner peripheral surface of the voice coil, and a space between an outer peripheral surface of the voice coil and an inner peripheral surface of the yoke. A rear surface side space between a rear surface of the diaphragm and a front surface of the plate communicates with a space outside the speaker device through a gap for communication which is formed in at least a part, in a peripheral direction of the voice coil, of the space between the outer peripheral surface of the plate and the inner peripheral surface of the voice coil.

Advantageous Effects of the Invention

According to the speaker device of the present invention, a magnet having no hole can be used as the magnet constituting the magnetic circuit. Therefore, the speaker device can be downsized or slimmed without being restricted by problems in manufacturing, such as cracking during sintering. Accordingly, it is possible to provide a compact speaker device which is more easily mountable, and enables reproduction in a wide frequency range.

DESCRIPTION OF EMBODIMENTS

Figure 1:
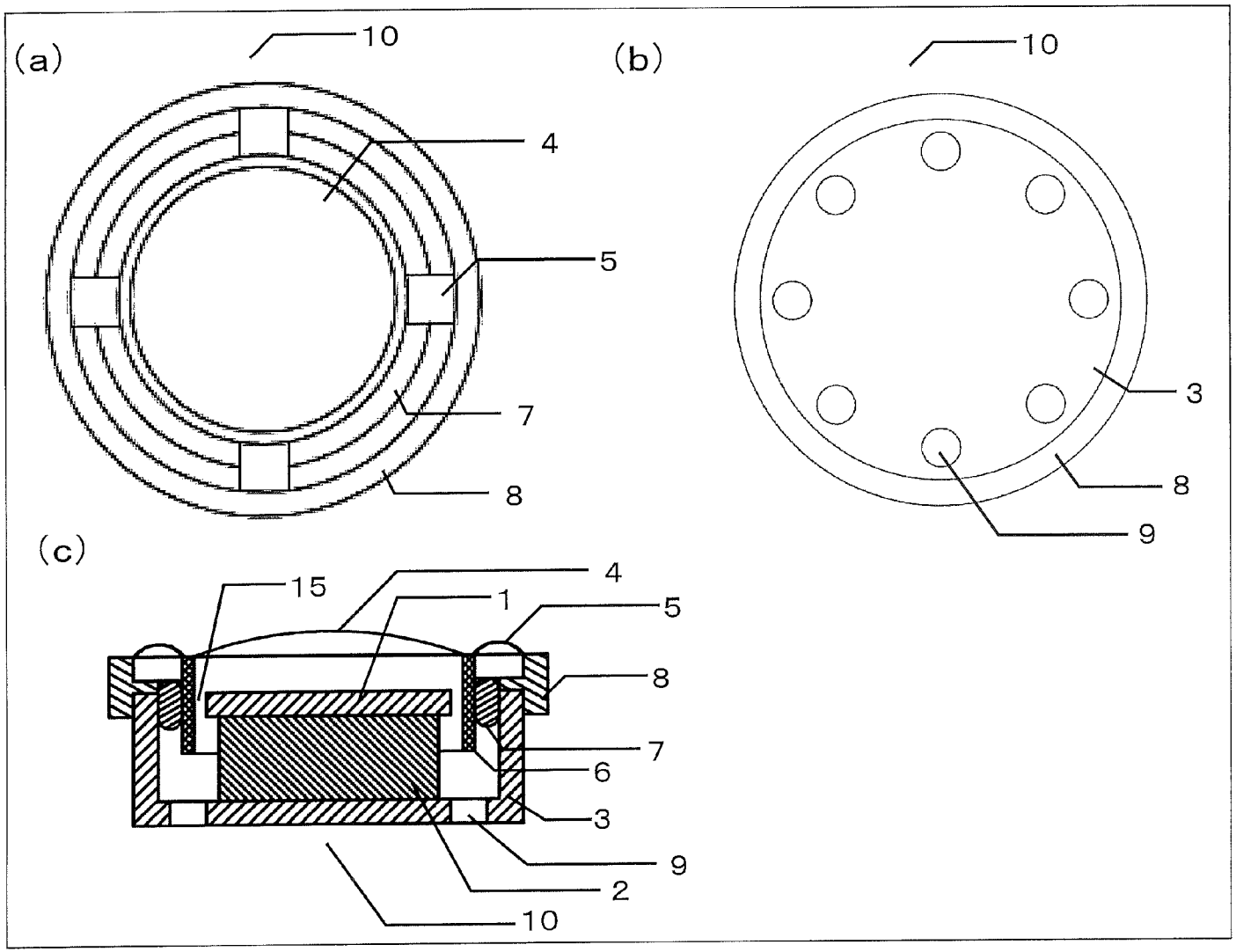
FIG. 1 shows a top view, a bottom view, and a structural cross-sectional view of a speaker device according to Embodiment 1.

Hereinafter, embodiments will be described with reference to the drawings. It should be noted that each of the embodiments described below shows a preferable and specific example of the present disclosure. The numerical values, shapes, materials, components, the arrangement and connection mode of the components, steps, the processing order of the steps etc. shown in the following embodiments are mere examples, and therefore do not limit the present disclosure. The present disclosure is limited only by the scope of the claims. Accordingly, among the components in the following embodiments, the component which is not defined in an independent claim representing the broadest concept of the present disclosure is described as not being necessarily required for achieving the object of the present disclosure but constituting a more preferred embodiment. The same reference numerals are assigned to the same components and descriptions for them may be omitted. In addition, all the embodiments described below can be configured by combining the matters described in the respective embodiments.

A speaker device according a first aspect includes: a magnetic circuit including a plate, a magnet having a surface fixed to one surface of the plate and having no through-hole, and a yoke fixed to a surface of the magnet opposite to the surface fixed to the plate and forming a magnetic gap between itself and an outer peripheral surface of the plate; a voice coil disposed in the magnetic gap; a diaphragm directly or indirectly fixed to the voice coil; a supporting part that supports the diaphragm; and a magnetic fluid disposed in at least one of a space between the outer peripheral surface of the plate and an inner peripheral surface of the voice coil, and a space between an outer peripheral surface of the voice coil and an inner peripheral surface of the yoke. A rear surface side space between a rear surface of the diaphragm and a front surface of the plate communicates with a space outside the speaker device through a gap for communication which is formed in at least a part, in a peripheral direction of the voice coil, of the space between the outer peripheral surface of the plate and the inner peripheral surface of the voice coil.

According a second aspect, in the speaker device according to the first aspect, a through-hole is formed in the yoke outside a region where the magnet is fixed to the yoke, and the rear surface side space communicates with the space outside the speaker device through the gap for communication and the through-hole of the yoke.

According to a third aspect, in the speaker device according to the first or second aspect, the outer peripheral surface of the plate has a pair of long-side side surfaces opposing each other in a short side direction of the plate, and a pair of short-side side surfaces opposing each other in a long side direction of the plate. In the space between the outer peripheral surface of the plate and the inner peripheral surface of the voice coil, the magnetic fluid is disposed outside the long-side side surfaces, and the gap for communication is formed outside at least a part of the short-side side surfaces According to a fourth aspect, in the speaker device according to the third aspect, portions of the inner peripheral surface of the voice coil, opposing the short-side side surfaces, are more distant from the outer peripheral surface of the plate than portions thereof opposing the long-side side surfaces.

According to a fifth aspect, in the speaker device according to the third aspect, projections projecting outward are formed at a part of the short-side side surfaces. In the space between the outer peripheral surface of the plate and the inner peripheral surface of the voice coil, the magnetic fluid is disposed outside top end surfaces of the projections.

According to a sixth aspect, in the speaker device according to the first or second aspect, the plate has a planar shape having cutouts at four corners. In the space between the outer peripheral surface of the plate and the inner peripheral surface of the voice coil the cutouts form the gaps for communication, and the magnetic fluid is disposed at portions other than the cutouts.

According to a seventh aspect, in the speaker device according to any one of the first to sixth aspects, the supporting part supports the diaphragm over the entire periphery of the diaphragm.

According to an eighth aspect, in the speaker device according to the first or second aspect, the supporting part includes a plurality of supporting members each supporting the diaphragm. Between the outer peripheral surface of the voice coil and the inner peripheral surface of the yoke, the magnetic fluid is disposed over the entire periphery in the peripheral direction of the voice coil.

According to a ninth aspect, in the speaker device according to the second aspect, the through-hole is formed in a side surface of an outer peripheral portion of the yoke.

According to a tenth aspect, in the speaker device according to the second aspect, a lead wire drawn from the voice coil passes through the through-hole.

According to an eleventh aspect, in the speaker device according to any one of the first to tenth aspects, the voice coil has a shape selected from a circular shape, a track shape, an oval shape, and a shape composed of a plurality of linear segments and a plurality of curved segments connecting the linear segments with each other.

According to a twelfth aspect, in the speaker device according to any one of the first to eleventh aspects, the distance between the inner peripheral surface of the voice coil and the outer peripheral surface of the plate is not uniform in the peripheral direction of the voice coil.

According to a thirteenth aspect, in the speaker device according to any one of the first to twelfth aspects, the yoke includes a plurality of the through-hole, and the plurality of the through-holes are arranged at equal angular intervals on a virtual circle concentric with a centroid axis of the voice coil parallel to a vibration direction of the diaphragm.

An audio visual equipment according to a fourteenth aspect includes the speaker device according to any one of the first to thirteenth aspects. A mobile information processing apparatus according to fifteenth aspect includes the speaker device according to any one of the first to thirteenth aspects. A vehicle according to a sixteenth aspect includes the speaker device according to any one of the first to thirteenth aspects. An earphone according to a seventeenth aspect includes the speaker device according to any one of the first to thirteenth aspects.

Embodiment 1

FIG. 1 shows a top view (FIG. 1(*a*)), a bottom view (FIG. 1(*b*)), and a structural cross-sectional view (FIG. 1(*c*)) of a coin type speaker device 10 according to Embodiment 1. The speaker device 10 includes a plate 1, a magnet 2, a yoke 3, a diaphragm 4, suspensions 5 (elastically deformable supporting members), a voice coil 6, a magnetic fluid 7, and a frame 8. The plate 1, the magnet 2, and the yoke 3 forms a magnetic circuit (a magnetic circuit of an internal magnetic type). A magnetic gap is formed between the plate 1 and the yoke 3. The voice coil 6 is located in the magnetic gap. The magnetic fluid 7 is disposed between the voice coil 6 and the yoke 3. The diaphragm 4 is supported by the frame 8 provided at an outer peripheral portion of the magnetic circuit, and the four suspensions 5 (supporting members) adhered to the diaphragm 4. At a bottom surface (bottom part) of the yoke 3, a plurality of through-holes 9 are formed in a region other than a region where the magnet 2 is adhered to the yoke 3. The plurality of through-holes 9 are symmetrical with respect to the center of the coin type speaker device 10. No through-hole is formed in the magnet 2 in a thickness direction thereof. This point is common to all the embodiments.

The speaker device 10 shown in FIG. 1(*a*) will be specifically described with an upper surface of the diaphragm 4 being a front surface, and a lower surface of the bottom part of the yoke 3 being a rear surface. The plate 1 is a circular plate facing a rear surface of the diaphragm 4. A front surface of the cylindrical magnet 2 is adhered to a rear surface of the plate 1. A rear surface of the magnet 2 is adhered to a front surface of the disk-like bottom part of the yoke 3. The plate 1, the magnet 2, and the bottom part of the yoke 3 are integrated so as to be substantially coaxial with each other. A cylindrical side wall, which is a part of the yoke 3, rises upward from an outer periphery of the bottom part of the yoke 3. A magnetic gap is formed between a side surface (outer peripheral surface) of the plate 1 and an inner peripheral surface of a front end portion of the side wall of the yoke 3. The magnetic fluid 7 is disposed between an outer peripheral surface of the substantially cylindrical voice coil 6 and the inner peripheral surface of the front end portion of the side wall of the yoke 3. The magnetic fluid 7 is disposed outside the voice coil 6. The voice coil 6 is adhered to an outer peripheral portion of the diaphragm 4. The frame 8 is formed in a ring shape, and is mounted to the front end portion of the side wall of the yoke 3. The frame 8 is disposed spaced apart from the outer periphery of the diaphragm 4. The frame 8 and the diaphragm 4 are connected to each other via the four suspensions 5. The four suspensions 5 are disposed at equal angular intervals. Each suspension 5 is formed in a band shape, and bulges frontward. At the bottom part of the yoke 3, the plurality of through-holes 9 are formed between the surface to which the magnet 2 is adhered and the side wall of the yoke 3. The plurality of through-holes 9 are arranged at equal angular intervals on a circle concentric with the center of the bottom part of the yoke 3. Each through-hole 9 is opened in a space (annular space) between the inner peripheral surface of the side wall of the yoke 3 and an outer peripheral surface of the magnet 2, and causes the annular space to communicate with a space outside the yoke 3 (i.e., a space outside the speaker device 10). The annular space is connected to a rear surface side space between the rear surface of the diaphragm 4 and a front surface of the plate 1 through a gap-for-communication 15 formed between the plate 1 and the voice coil 6.

Hereinafter, the operation of the speaker device 10 will be described. When an electric signal flows through the voice coil 6, a driving force according to a signal current is applied to the voice coil 106 in accordance with the Fleming's left-hand rule, and the diaphragm 4 vibrates, and thereby a sound is reproduced.

In the speaker device 10 of the present embodiment, assuming that the upper side in FIG. 1 corresponds to the front surface of the diaphragm 4, a sound of a positive phase is output from the front surface of the diaphragm 4 and, simultaneously, a sound of an inverse phase is output from the rear surface of the diaphragm 4. If the magnetic fluid 7 is not disposed, the sound of the inverse phase passes through the space between the voice coil 6 and the yoke 3 and reaches the front surface side of the diaphragm 4. At this time, signal components in a frequency band in which a difference in acoustic path between the sound of the positive phase and the sound of the inverse phase is less than ½ wavelength are canceled out with each other. In the present embodiment, however, since the magnetic fluid 7 is disposed between the voice coil 6 and the yoke 3 and blocks the sound of the inverse phase, such canceling does not occur. In a case of a general speaker device, since a suspension supports the entire periphery of a diaphragm, a sound from the rear surface is blocked by the suspension (so-called edge). On the other hand, in the present embodiment, the magnetic fluid 7 blocks the sound from the front surface and the sound from the rear surface. Therefore, the suspensions 5 (edges) need not support the entire periphery of the diaphragm 4. Accordingly, in the present embodiment, as shown in the top view of FIG. 1(*a*), the supporting part for supporting the diaphragm 4 is composed of the four suspensions 5. The supporting part does not support the entire periphery of the diaphragm 4. As compared to the case where the entire periphery of the diaphragm 4 is supported, the stiffness of the supporting part can be reduced.

Therefore, the minimum resonance frequency of the speaker device 10 can be lowered, thereby realizing rich bass reproduction ability.

While in FIG. 1 the suspensions 5 are adhered to the outer peripheral portion of the diaphragm 4, the suspensions 5 may be adhered to the center or other portions of the diaphragm 4. In addition, the number of the suspensions 5 is not limited to four. In addition, the arrangement of the suspensions 5 is not limited to that shown in FIG. 1(*a*). Another arrangement may be adopted in which a plurality of suspensions 5 are disposed symmetrically with respect to a centroid axis parallel to the vibration direction of the diaphragm 4. If the effect of reducing the stiffness of the suspensions 5 is not expected, a single suspension 5 may support the entire outer periphery of the diaphragm 4. The suspensions 5 supporting the diaphragm 4 merely mean that the suspensions 5 and the diaphragm 4 are adhered to each other.

The sound from the rear surface of the diaphragm 4 can be released to the outside of the speaker device 10 through the gap-for-communication 15 formed between the voice coil 6 and the plate 1, and the through-holes 9 of the yoke 3. Therefore, the bass reproduction ability of the speaker device 10 can be prevented from being inhibited by the stiffness of air in the space at the rear surface of the diaphragm 4.

Since the magnet 2 having no hole is used as shown in FIG. 1, the shape of the speaker device 10 is prevented from being limited by the shape of the magnet. Therefore, it is possible to forms a thin or slim speaker device 10. Further, since the magnet 2 having no hole is used, cracking or the like is less likely to occur during sintering of the magnet.

As described above, when the magnet 2 having no hole is used, the problem of stiffness of air at the rear surface of the diaphragm 4 may occur if the through-holes 9 are not provided. In the present embodiment, however, the space at the rear surface side, which is surrounded by the diaphragm 4, the voice coil 6, and the plate 1, is connected to the space surrounded by the magnet 2, the yoke 3, the magnetic fluid 7, and the voice coil 6 through the gap-for-communication 15 formed between the inner surface of the voice coil 6 and the outer peripheral surface of the plate 1, and further, connected to the space outside the speaker device 10 through the through-holes 9 formed in the yoke 3. Accordingly, air at the rear surface of the diaphragm 4 is not confined in the speaker device 10, thereby preventing the bass reproduction from being inhibited by the stiffness of air. Accordingly, it is possible to provide the speaker device 10 having high flexibility in shape, and high ability of bass reproduction.

While in FIG. 1 the voice coil 6 is directly adhered to the diaphragm 4, the voice coil 6 may be indirectly fixed to the diaphragm 4 by using a voice coil bobbin or the like.

Further, since the through-holes 9 are provided to be symmetrical with respect to the center axis of the coin type speaker device 10, the pressure at the rear surface of the diaphragm 4 is also symmetrical with respect to the center axis, and thereby rolling vibration is not likely to occur. However, for example, when the through-holes 9 cannot be formed to be symmetrical with respect to the center axis of the speaker device 10 because of arrangement of terminals on a rear surface of a speaker unit including the speaker device 10 or arrangement of other members, the through-holes 9 may be formed to be asymmetrical with respect to the center axis of the speaker device 10. In addition, each through-hole 9 is a circular hole. However, each through-hole 9 may have a rectangular shape, an oval shape, a track shape (a shape obtained by combining curved lines and straight lines, like a track for athletic sports), or other shapes. Although the plurality of through-holes 9 have the same shape in FIG. 1(*b*), through-holes having different shapes such as a circular shape, a rectangular shape, an oval shape, a track shape, and other shapes may be combined.

Embodiment 2

Figure 2:
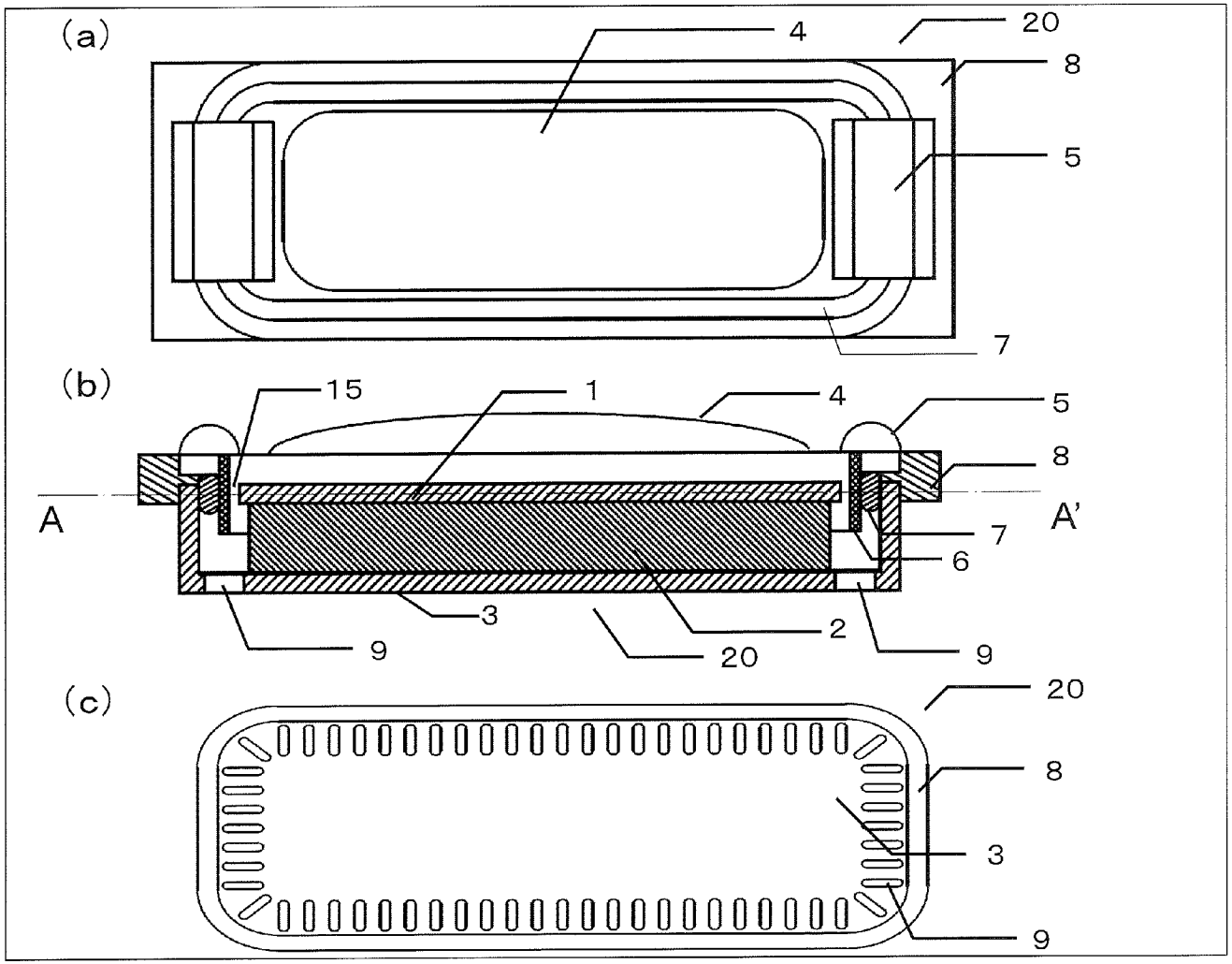
FIG. 2 shows a top view, a structural cross-sectional view, and a bottom view of a speaker device according to Embodiment 2.

FIG. 2 shows a top view (FIG. 2(*a*)), a structural cross-sectional view (FIG. 2(*b*)), and a bottom view (FIG. 2(*c*)) of a speaker device 20 according to Embodiment 2. Since components included in the speaker device 20 shown in FIG. 2 are identical in function to the components included in the speaker device 10 according to Embodiment 1, description thereof will partially be omitted. The components of the speaker device 20 are denoted with the same reference numerals as those of the speaker device 10. The speaker device 20 is different from the speaker device 10 of Embodiment 1 in that the speaker device 20 has a rectangular shape while the speaker device 10 has a circular (coin) shape. Accordingly, the shapes of the components of the speaker device 20 are different from those of the speaker device 10 of Embodiment 1. In addition, while the number of the suspensions 5 is four in the speaker device 10 of Embodiment 1, in the speaker device 20, the diaphragm 4 is supported by two suspensions 5 provided at two short-side portions opposing each other in the long side direction, respectively. Each suspension 5 extends from the frame 8 to the diaphragm 4 along the long side direction of the speaker device 20.

Since the operation of the speaker device 20 is identical to that of the speaker device 10, repeated description is not necessary.

In the speaker device 20, the diaphragm 4 is supported by the two suspensions 5 respectively disposed at the two short-side portions (the short-side portions of the frame 8) opposing each other in the long side direction. Therefore, as compared to a case where suspensions 5 are disposed also at the long-side portions of the frame 8, the length of the speaker device 20 in the short side direction can be reduced. Thus, it is possible to provide the speaker device having a high vertical-to-horizontal aspect ratio. Accordingly, it is possible to mount the speaker device 20 on an image display device such as a television having a narrow outer frame of a screen, which is a design trend, or on equipment in which the location of the speaker device 20 is greatly restricted.

The plate 1, the magnet 2, the side wall of the yoke 3, and the voice coil 6 each have, as viewed from the front, a shape of a rectangle whose four corners are shaped into curved lines (a shape of a rectangle whose four corners are rounded), that is, a shape having linear segments and curved segments. The magnet 2 may have a rectangular parallelepiped shape. A surface of the yoke 3 (an inner peripheral surface of the side wall), opposing the plate 1, may have a substantially quadrangular shape. In this case, however, at the corners of the side wall of the yoke 3, the magnetic fluid 7 may climb toward the upper surface or the lower surface of the yoke 3 due to capillary phenomenon. In this case, the magnetic fluid 7 in the magnetic gap may be reduced, and cannot perform its assigned duty. This situation is undesirable. Therefore, it is desired that the corners of the side wall of the yoke 3 are shaped into curved lines to prevent such capillary phenomenon. More specifically, it is desired that the radius of curvature at each corner of the side wall of the yoke 3 is 0.5 mm or more.

Figure 3:
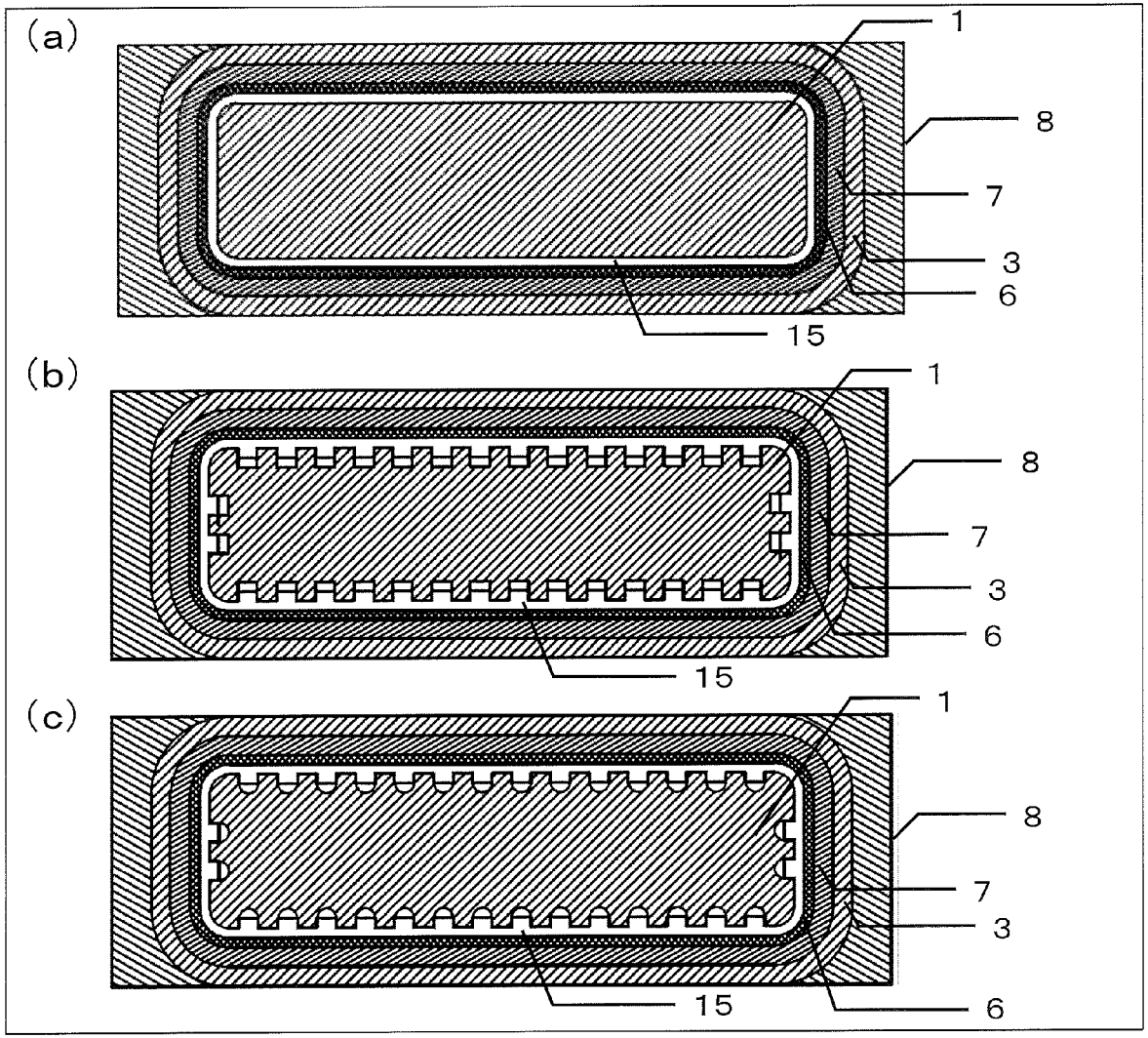
FIG. 3 shows a structural cross-sectional view of the speaker device according to Embodiment 2 (a A-A' cross section of the speaker device shown in FIG. 2(*b*)).

Each through-hole 9 is formed as a hole having a track shape (a shape obtained by combining curved lines and straight lines, like a track for athletic sports). As shown in FIG. 2(*c*), the longitudinal direction of each through-hole 9, when the speaker device 20 is viewed in perspective from the front, extends substantially perpendicularly to a portion of the voice coil 6 that overlaps the through-hole 9. The purpose of forming the through-hole 9 as described above is to reduce the cross-sectional area perpendicular to the flow of magnetic flux (reduce the length of the through-hole 9 in the direction perpendicular to the flow of magnetic flux) so as not to impede the flow of magnetic flux as much as possible. As a result, the magnetic resistance of the yoke 3 is reduced, and the density of magnetic flux in the magnetic gap is increased, thereby achieving a large driving force in the voice coil 6. Each through-hole 9 may have a rectangular shape, a circular, shape, an oval shape, or other shapes. The plurality of through-holes 9 may have different shapes as described above including the track shape. FIGS. 3(*a*), 3(*b*), and 3(*c*) are cross-sectional views taken along an alternate long and short dash line A-A' in FIG. 2, showing examples of the shape of the plate 1 in Embodiment 2.

The plate 1 shown in FIG. 3(*a*) is a plate having a shape of a rectangle having curved-line portions at four corners thereof. The width of the magnetic gap is uniform over the entire periphery of the plate 1, and thereby a stable driving force is achieved substantially uniformly over the entire periphery of the voice coil 6. However, strictly speaking, when this shape is adopted, the density of magnetic flux tends to be reduced at the curved-line portions. So, the width of the magnetic gap may be reduced only at the curved-line portions of the plate 1. At this time, the side surface of the plate 1 may be brought close to the yoke 3, or the surface (the inner surface of the side wall) of the yoke 3, opposing the plate 1, may be brought close to the plate 1.

The plate 1 shown in FIG. 3(*b*) is a plate having a shape of a rectangle with curved-line portions at four corners thereof, and having projections and recesses formed in the straight-line portions on the outer periphery. The projections and recesses are formed by forming a plurality of recesses in the straight-line portions on the outer periphery. In each recess, a pair of side parts extends outward from both ends of a bottom part. The side parts and the bottom part of the recess are linearly formed. The plate 1 shown in FIG. 3(*c*) is a plate having a shape of a rectangle with curved-line portions at four corners thereof, and having projections and recesses formed in the straight-line portions on the outer periphery, and further, having bottom parts of the recesses being shaped into curved lines. By appropriately designing the recesses in the plate 1, the magnetic flux can be concentrated to the projections, thereby realizing a magnetic circuit whose driving force is hardly reduced. Further, as compared with the plate 1 having no projections and recesses at the side surface thereof, the recesses cause an increase in the cross-sectional area of the air flow path (the cross-sectional area of the gap for communication) formed between the voice coil 6 and the plate 1. As a result, high acoustic impedance is prevented from occurring in the narrow air flow path between the plate 1 and the voice coil 6, thereby providing the speaker device 20 having good high frequency characteristics.

It is needless to say that the shape of the plate 1 having projections and recesses at the peripheral edge thereof can be applied to the circular plate 1 of the speaker device 10 according to Embodiment 1.

Regarding the suspensions 5, one suspension 5 is disposed at each of the short-side portions opposing each other in the long side direction. However, the arrangement of the suspensions 5 is not limited thereto. For example, two suspensions 5 may be disposed at each of the short-side portions opposing each other in the long side direction (i.e., four suspensions 5 in total may be disposed), or suspensions 5 may be disposed at the long-side portions opposing each other in the short side direction. Alternatively, suspensions 5 may be disposed at the curved-line portions of the diaphragm 4.

Embodiment 3

Figure 4A:
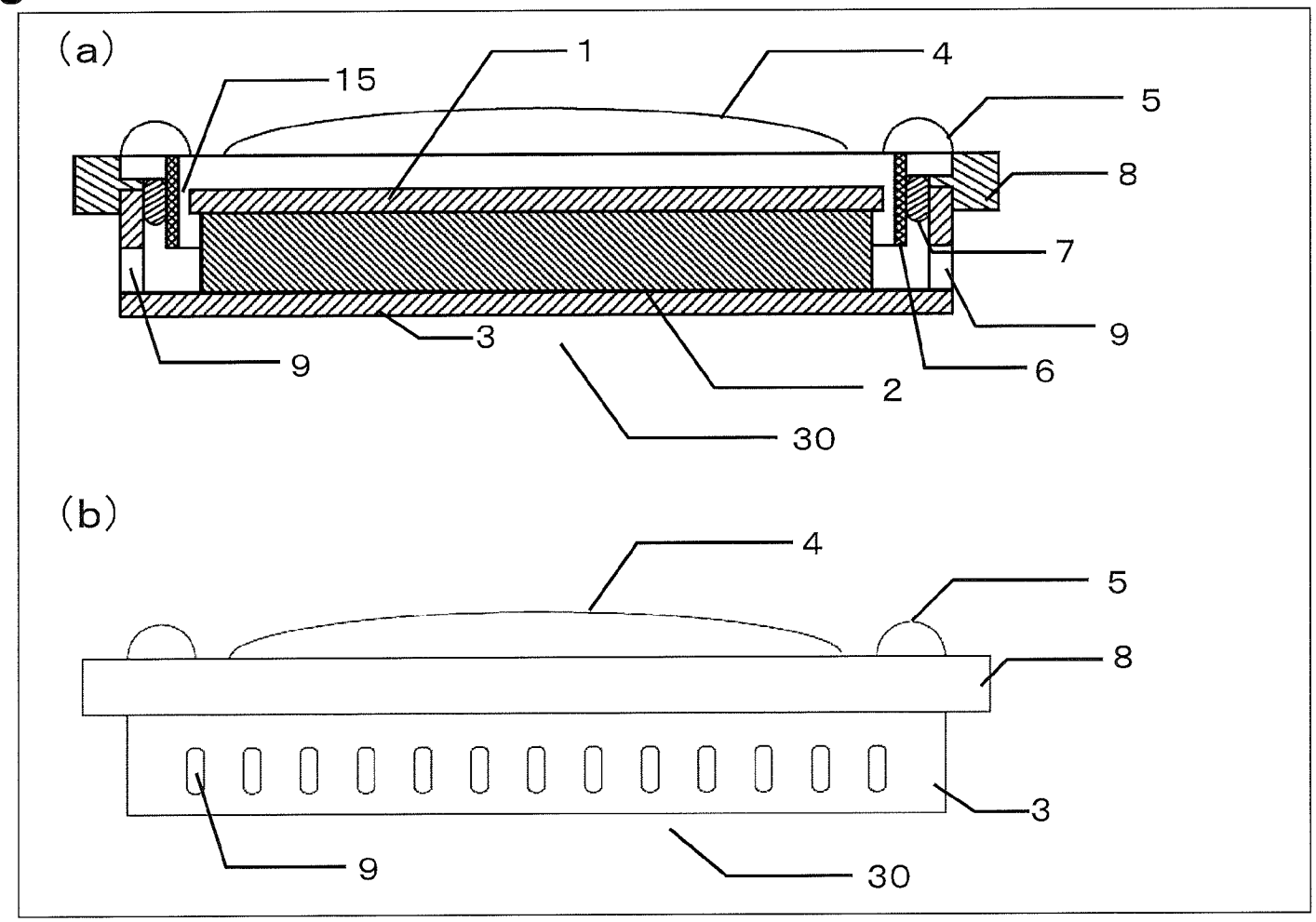
FIG. 4A shows a structural cross-sectional view and a side view of a speaker device according to Embodiment 3.
Figure 4B:
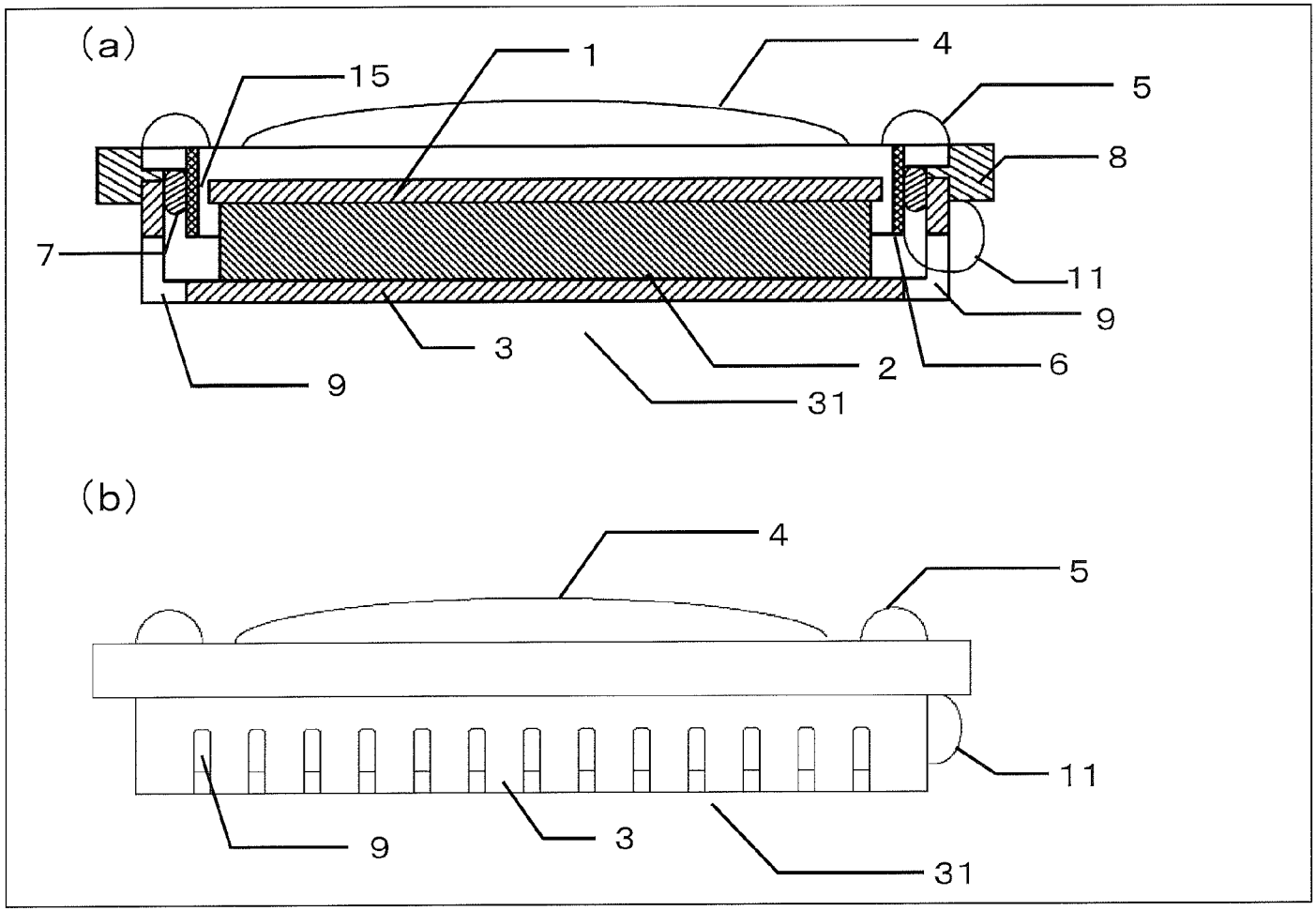
FIG. 4B shows a structural cross-sectional view and a side view of a speaker device of a mode different from the speaker device of Embodiment 3 shown in FIG. 4A.

FIG. 4A shows a structural cross-sectional view (FIG. 4A(*a*)) and a side view (FIG. 4A(*b*)) of a speaker device 30 according to Embodiment 3. FIG. 4B shows a structural cross-sectional view (FIG. 4B(*a*)) and a side view (FIG. 4B(*b*)) of a speaker device 31 of a mode different from the speaker device 30 shown in FIG. 4A. Since components included in the speaker device 30 shown in FIG. 4A are identical in function to the components of the speaker device 10 according to Embodiment 1, description thereof will partially be omitted. The components of the speaker device 30 are denoted with the same reference numerals as those of the speaker device 10. The speaker device 31 shown in FIG. 4B includes a lead wire 11 (a wire drawn from the voice coil 6) in addition to the components of the speaker device 10.

Since the operation of the speaker device is identical to that of Embodiment 1, repeated description is not necessary.

The speaker device 30 and the speaker device 31 are different from the speaker devices of Embodiments 1 and 2 in the positions of through-holes 9 provided in the yoke 3. The through-holes 9 are formed in the outer peripheral portion of the yoke 3 (the side wall rising upward from the bottom part of the yoke 3). In the speaker device 30, the entirety of each through-hole 9 is formed in the side wall of the yoke 3. In the speaker device 31, each through-hole 9 is formed extending from an outer portion of the bottom part of the yoke 3 to a lower portion of the side wall of the yoke 3. Therefore, when the speaker device 30 or 31 is directly placed on a cabinet with the bottom surface contacting the cabinet, the through-holes 9 are not closed. Accordingly, reduction in the thickness of the entire cabinet can be realized. That is, while using the magnet 2 having no hole as in Embodiments 1 and 2, the through-holes 9 are provided to prevent bass reproduction from being inhibited by the stiffness of air, and moreover, the through-holes 9 are not likely to be closed by external members.

Furthermore, the lead wire 11 drawn from the voice coil 6 may be made to pass through the through-hole 9, as in the speaker device 31 shown in FIG. 4B. Each through-hole 9 is formed extending from the bottom part of the yoke 3 to the side wall of the yoke 3. Alternatively, the lead wire 11 may be pulled out through a gap between the plurality of suspensions 5. One end of the lead wire 11 is integrated with or electrically connected to the voice coil 6 that vibrates. Therefore, in order to prevent abnormal noise caused by undesired contact, a certain space needs to be secured around the lead wire 11, particularly, in the direction of vibration. However, by effectively utilizing the vacant spaces as described above, it is possible to realize a compact speaker device 31 having a good space factor while avoiding abnormal noise. That is, while using the magnet 2 having no hole as in Embodiments 1 and 2, the through-holes 9 are provided to prevent bass reproduction from being inhibited by the stiffness of air, and moreover, the through-holes 9 are effectively utilized as spaces through which the lead wire is pulled out.

Embodiment 4

Figure 5:
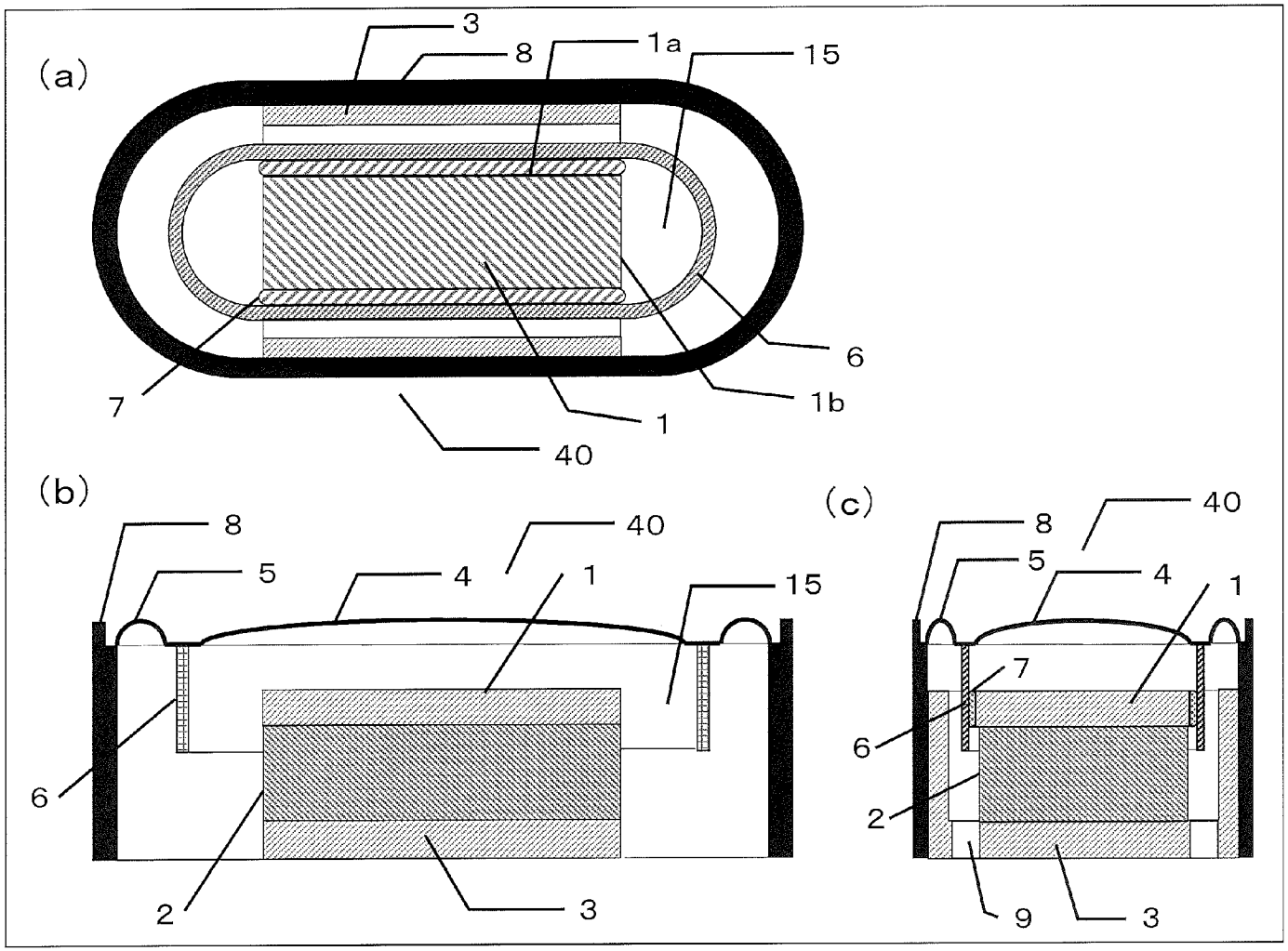
FIG. 5 shows a horizontal cross-sectional view, a vertical cross-sectional view in a long side direction, and a vertical cross-sectional view in a short side direction, of a speaker device according to Embodiment 4.

FIG. 5 shows a horizontal cross-sectional view of a speaker device 40 according to Embodiment 4 (FIG. 5(*a*)), a vertical cross-sectional view of the speaker device 40 which is cut along the long side direction (FIG. 5(*b*)), and a vertical cross-sectional view of the speaker device 40 which is cut along the short side direction (FIG. 5(*c*)).

In the speaker device 40 according to Embodiment 4, in the space between the outer peripheral surface of the plate 1 and the inner peripheral surface of the voice coil 6, the magnetic fluid 7 is disposed in a part of the above space in the peripheral direction of the voice coil 6, and the gap-for-communication 15 is formed at a residual part of the voice coil 6. Further, no magnetic fluid 7 is disposed in the space between the outer peripheral surface of the voice coil 6 and the inner peripheral surface of the side wall of the yoke 3, and a gap is formed over the entire periphery. In these points, Embodiment 4 is different from Embodiments 1 to 3.

Since the operation of the speaker is identical to that of Embodiment 1, repeated description is not necessary.

Regarding the shapes of the respective components when the speaker device 40 of Embodiment 4 is viewed from the front surface side, the plate 1 has a rectangular shape, and the voice coil 6 and the frame 8 each have a track shape. As for the yoke 3, side walls of the yoke 3 rise up toward the front surface from only a pair of long sides of the rectangular bottom part of the yoke 3. No side walls are provided at the short sides of the bottom part of the yoke 3. Each side wall opposes each straight-line portion of the voice coil 6 with a gap between them. In addition, a suspension 5 is provided over the entire periphery of the diaphragm 4.

In Embodiment 4, the outer peripheral surface of the plate 1 has a pair of long-side side surfaces 1*a* (side surfaces at the long sides) opposing each other in the short side direction of the plate 1, and a pair of short-side side surfaces 1*b* (side surfaces at the short sides) opposing each other in the long side direction of the plate 1. In the space between the outer peripheral surface of the plate 1 and the inner peripheral surface of the voice coil 6, the magnetic fluid 7 is disposed outside the long-side side surfaces 1*a*, and the gaps-for-communication 15 are formed outside the short-side side surfaces 1*b*. Each gap-for-communication 15 connects the rear surface side space between the rear surface of the diaphragm 4 and the front surface of the plate 1 to the space outside the yoke 3 through the space between the outer peripheral surface of the magnet 2 and the inner peripheral surface of the yoke 3. The magnetic fluid 7 is disposed between the long-side side surfaces 1*a* and the straight-line portions of the voice coil 6. As for the inner peripheral surface of the voice coil 6, the curved-line portions opposing the short-side side surfaces 1*b* are more distant from the outer peripheral surface of the plate 1 than the straight-line portions opposing the long-side side surfaces 1*a*. In addition, a plurality of through-holes 9 are formed in the yoke 3 as in Embodiments 1 to 3.

According to Embodiment 4, since the magnetic fluid 7 is provided at the inner side of the voice coil 6 where the magnetic force is greater than that at the outer side of the voice coil 6, the magnetic fluid 7 can be easily arranged at the time of manufacturing the speaker device 40. In addition, since the magnetic fluid 7 is provided at the long sides of the voice coil 6, the rolling preventing effect due to viscosity can be enhanced as compared to the case of providing the magnetic fluid 7 on the short sides.

Furthermore, since the gaps-for-communication 15 are left inside the voice coil 6 while the magnetic fluid 7 is provided inside the voice coil 6, bass reproduction is prevented from being inhibited by the stiffness of air. The gaps-for-communication 15 are formed so as to have a relatively large width inside the curved-line portions of the voice coil 6. Therefore, occurrence of high acoustic impedance in the narrow air flow path between the plate 1 and the voice coil 6 is prevented, thereby providing the speaker device 40 with good high frequency characteristics.

Further, since the magnetic fluid 7 is provided not over the entire periphery of the voice coil 6, when the outer periphery of the diaphragm 4 is partially supported by the suspensions 5 as in Embodiments 1 to 3, a sound of inverse phase from the rear surface of the diaphragm 4 cancels a sound of positive phase from the front surface of the diaphragm 4. However, since the entire periphery of the diaphragm 4 is supported by the suspension 5, the sound from the rear surface of the diaphragm 4 is prevented from leaking to the front surface side of the speaker device 40, thereby preventing such sound canceling.

Embodiment 5

Figure 6:
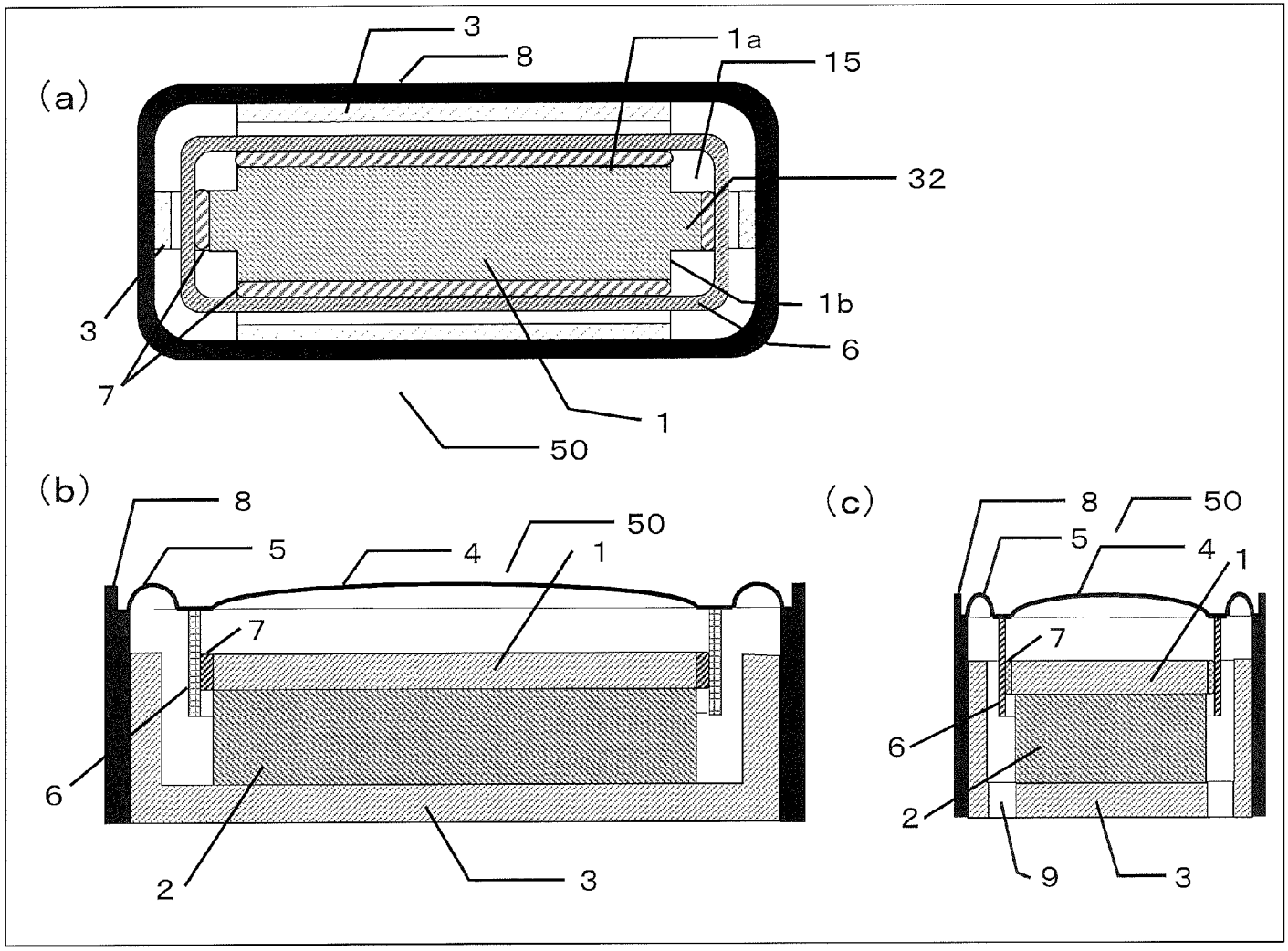
FIG. 6 shows a horizontal cross-sectional view, a vertical cross-sectional view in a long side direction, and a vertical cross-sectional view in a short side direction, of a speaker device according to Embodiment 5.

FIG. 6 shows a horizontal cross-sectional view of a speaker device 50 according to Embodiment 5 (FIG. 6(*a*)), a vertical cross-sectional view of the speaker device 50 which is cut along the long side direction (FIG. 6(*b*)), and a vertical cross-sectional view of the speaker device 50 which is cut along the short side direction (FIG. 6(*c*)).

The speaker device 50 of the Embodiment 5 is different from Embodiment 4 in that, in the space between the outer peripheral surface of the plate 1 and the inner peripheral surface of the voice coil 6, the magnetic fluid 7 is also disposed outside portions of the short-side side surfaces 1*b*.

Since the operation of the speaker is identical to that of Embodiment 1, repeated description is not necessary.

Regarding the shapes of the respective components when the speaker device 50 of Embodiment 5 is viewed from the front surface side, the voice coil 6 and the frame 8 each have a rectangular shape whose four corners are rounded. In addition, the plate 1 has a planar shape in which a projection 32 is formed at each of the short-side side surfaces 1*b*, specifically, the projection 32 projecting outward is formed at a portion of each short-side side surface 1*b*. That is, the plate 1 has a planar shape in which cutouts are formed at four corners of a rectangle. In addition, As for the yoke 3, side walls rise up toward the front surface not only from the pair of the long sides of the rectangular bottom part of the yoke 3 but also from the center portions of the pair of the short sides thereof. The side wall at each short side is provided corresponding to each projection 32. The side wall at each short side is provided outside a front end surface of each projection 32 so as to have substantially the same length as the front end surface. The side wall at each short side opposes the outer peripheral surface of the voice coil 6 in the short side direction, with a gap between them.

In the space between the outer peripheral surface of the plate 1 and the inner peripheral surface of the voice coil 6, the gaps-for-communication 15 are formed by the cutouts of the plate 1, and the magnetic fluid 7 is disposed at portions other than the cutouts. The magnetic fluid 7 is disposed outside the top end surfaces of the projections 32 as well as outside the long-side side surfaces 1*a*.

According to the present embodiment, the magnetic fluid 7 is disposed not only at the long sides of the voice coil 6 but also at the short sides thereof. Therefore, the rolling preventing effect due to viscosity can be enhanced as compared to the case of providing the magnetic fluid 7 at only the long sides of the voice coil 6. Accordingly, more stable vibration of the diaphragm 4 can be realized.

Embodiment 6

Figure 7:
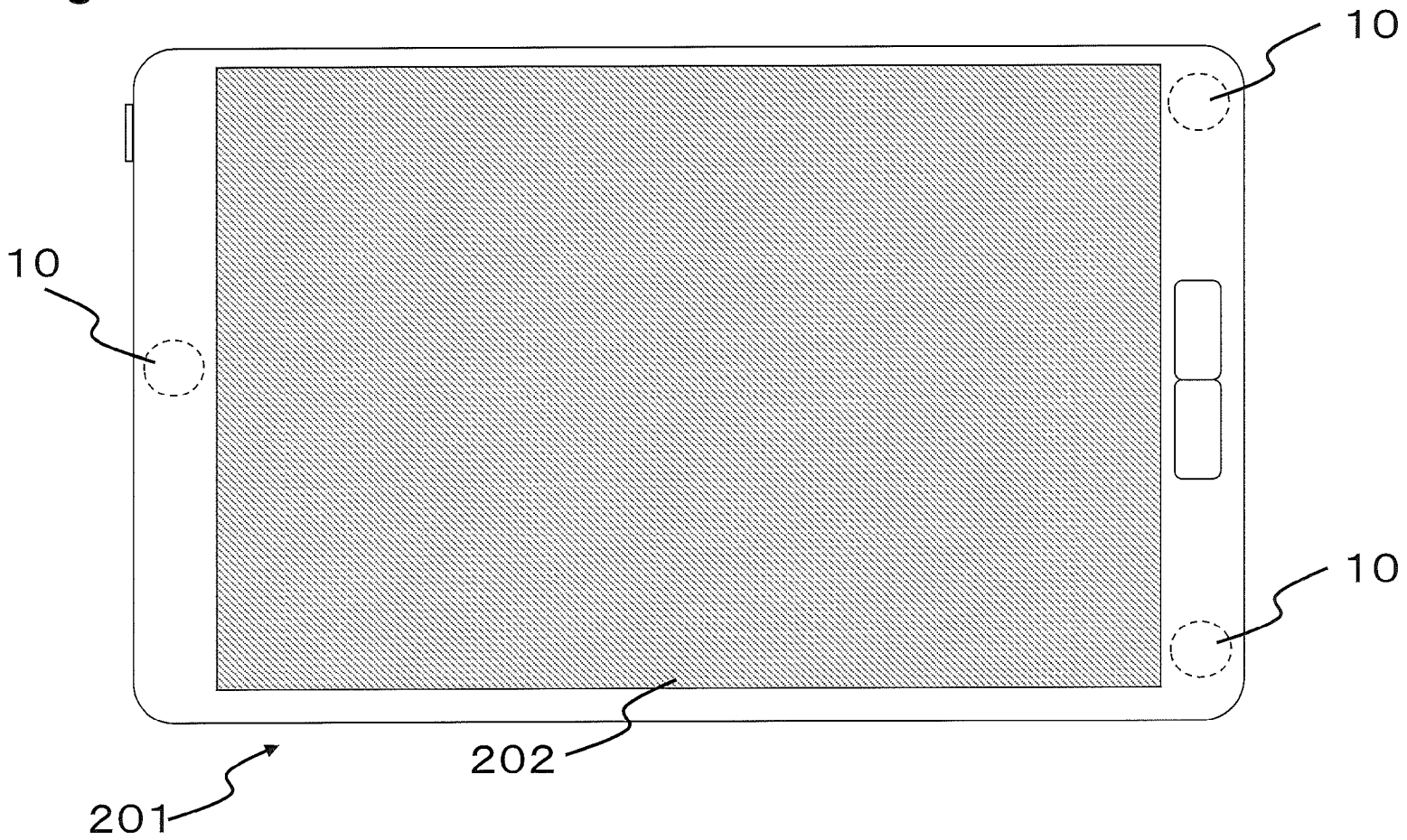
FIG. 7 is a front view of a mobile information terminal apparatus according to Embodiment 6.

FIG. 7 shows a mobile information terminal apparatus 201 according to Embodiment 6. In FIG. 7, reference numeral 202 denotes a screen, and reference numeral 10 denotes a speaker device. As shown in FIG. 7, the above-mentioned speaker device 10 is used in the mobile information terminal apparatus 201. In FIG. 7, the speaker device 10 is disposed at three locations, but the number of the speaker devices 10 may be any number as long as the number is one or more. The speaker device 10 may be used as a speaker for reproduction of a ringtone. Alternatively, the speaker device 10 may be used as a speaker used for reproduction of a speech voice, that is, a so-called receiver.

Figure 8:
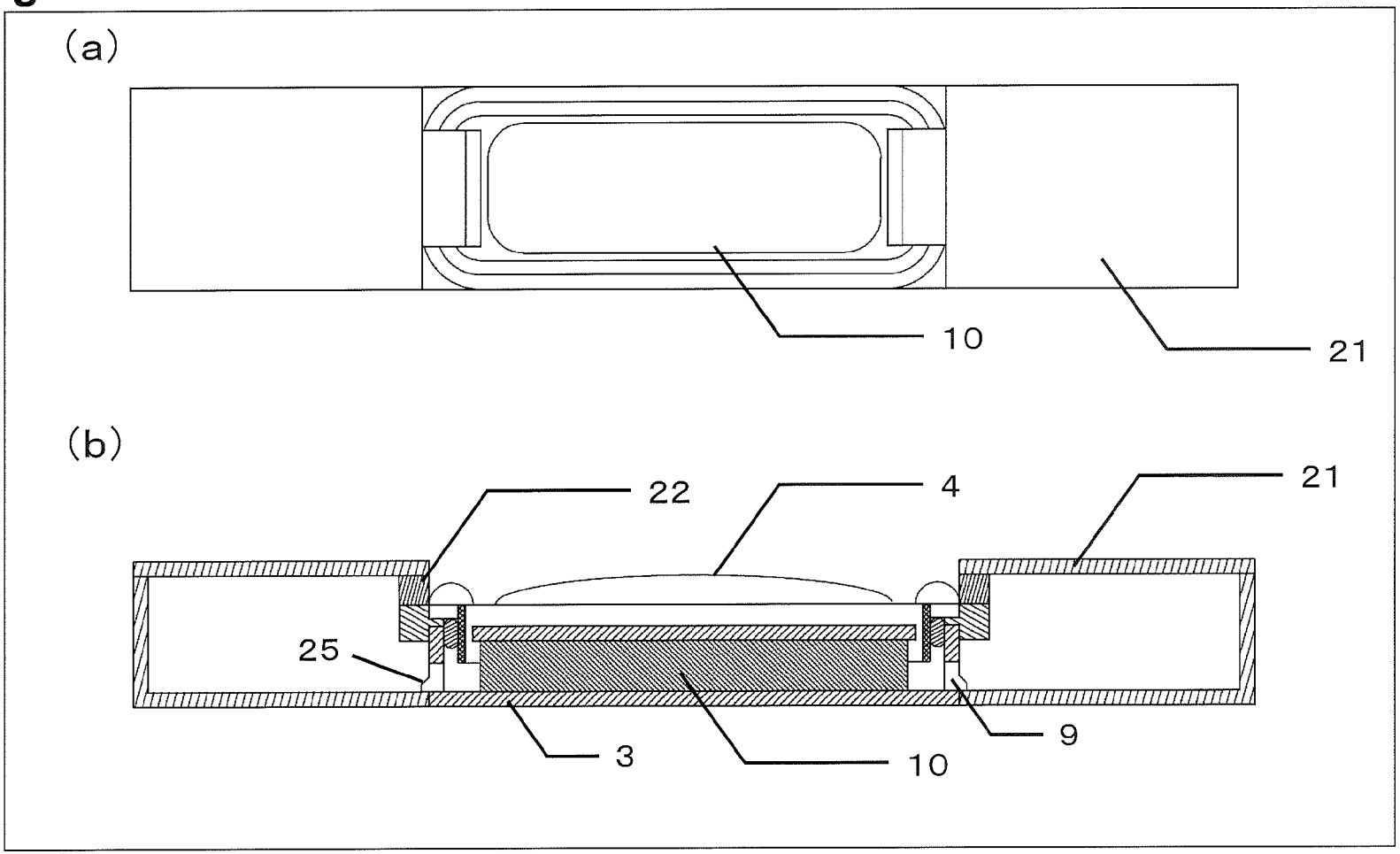
FIG. 8 shows a top view and a structural cross-sectional view of a speaker device according to Embodiment 6.

FIG. 8 shows an example of the speaker device 10 mounted to a mobile information terminal apparatus. FIG. 8 shows a top view (FIG. 8(*a*)) and a structural cross-sectional view (FIG. 8(*b*)) of the speaker device 10. In many cases, a speaker device to be mounted to a mobile information terminal apparatus is mounted in or integrated with a cabinet of the mobile information terminal apparatus, and FIG. 8 shows the speaker device 10 mounted in a cabinet of the mobile information terminal apparatus. As described for Embodiment 3, the through-holes of the yoke 3 are formed in the side surface (side wall) of the yoke 3. Therefore, the bottom surface (bottom part) of the yoke 3 of the speaker device 10 can be used as a part of a cabinet 21, and thus the entirety of the speaker cabinet 21 can be thinned.

Further, in order to facilitate mounting of the speaker device 10 in the cabinet 21, as shown in FIG. 8(*b*), a projection 25 is provided on the outer peripheral portion (side wall) of the yoke 3. The projection 25 is caught by an edge of a hole in which the bottom part of the yoke 3 of the speaker device 10 is fitted. This projection 25 may be formed on the frame or any other part, or may be dispensed with if such design is not needed.

A cushioning material 22 is disposed on the front surface of the speaker device 10. Thus, the speaker device 10 is in close contact with the cabinet 21, thereby preventing a reduction in the bass reproduction ability due to leakage of air from the cabinet 21.

While the cabinet 21 shown in FIG. 8 is a closed type cabinet, a bass reflex port or a passive cone may be formed.

Figure 9:
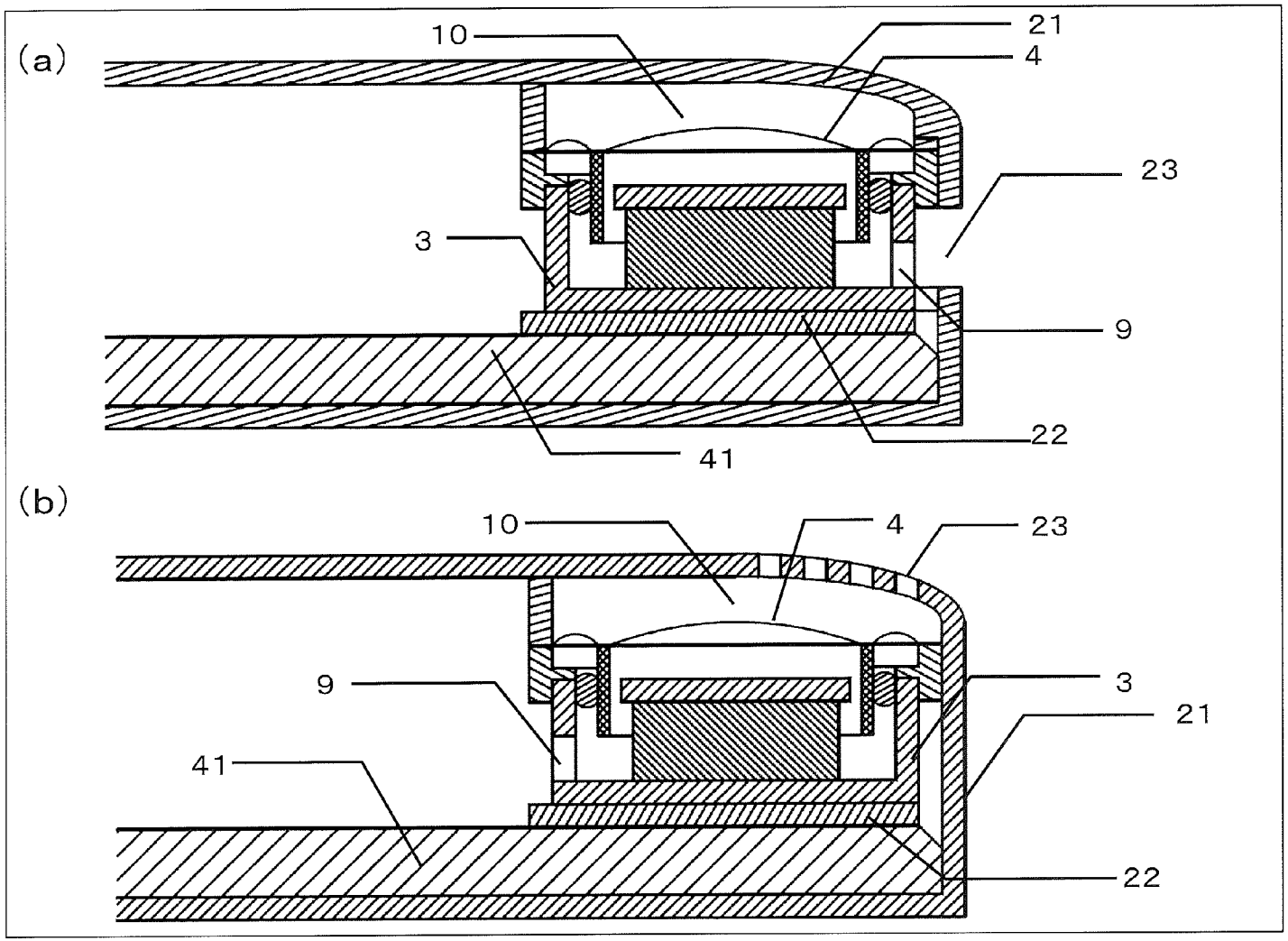
FIG. 9 is a cross-sectional view of the mobile information terminal apparatus according to Embodiment 6.

FIGS. 9(*a*) and 9(*b*) each show an example of the speaker device 10 mounted to a mobile information terminal apparatus. In FIGS. 9(*a*) and 9(*b*), reference numeral 41 denotes an image display device formed of liquid crystal, organic EL, or the like. In FIG. 9(*a*), an opening 23 is provided in the cabinet 21, and outlets of the through-holes 9 formed in the yoke 3 of the speaker device 10 face the opening 23, so that sound reproduced from the side surface of the speaker device 10 is emitted through the opening 23. In this case, the through-holes 9 are provided only on the side where the opening 23 of the cabinet 21 is provided, and no through-holes 9 are formed in a portion, facing the inside of the cabinet 21, of the side wall of the yoke 3.

Figure 10:
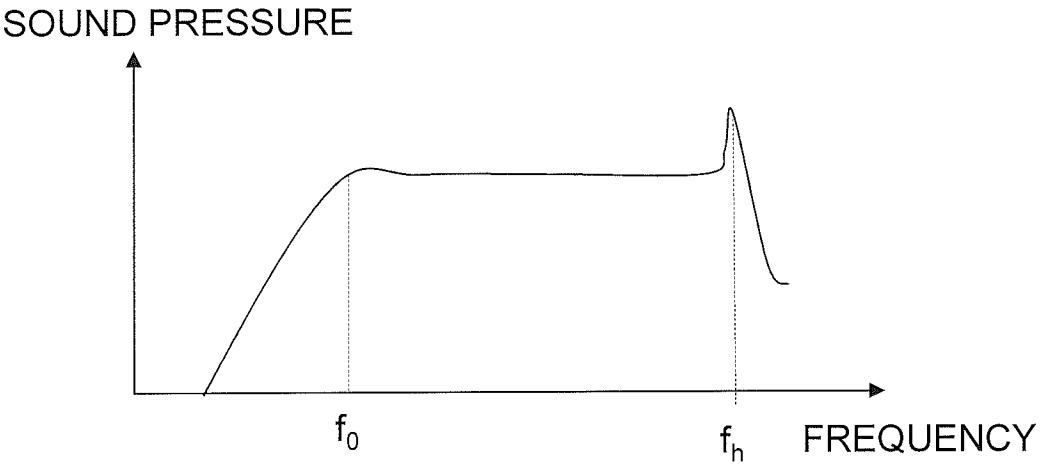
FIG. 10 is a graph showing the relationship between a minimum resonance frequency and a sound pressure.

In the case of FIG. 9(*a*), the space connected to the through-holes 9 (the space between the outer peripheral surface of the magnet 2 and the side wall of the yoke 3, and the space at the rear surface side of the diaphragm 4) is partitioned by the magnetic fluid 7 from the space at the front surface side of the diaphragm 7. The total volume of this space is relatively small, and for example, is smaller than the volume of the space at the front surface side of the diaphragm 7. The condition that the volume of the space connected to the through-hole 9 is large and the condition that the area of the through-holes 9 is small may lead to a degradation in the quality (high-frequency sound quality) of sound emitted from the through-holes 9. In the case of FIG. 9(*a*), since the space connected to the through-hole 9 can be made relatively small, the sound quality can be secured even when the through-holes 9 are not very large. Regarding the case where the sound emitted from the through-holes 9 is the reproduced sound, the frequency limit of high-frequency reproduction is determined by a resonance frequency $f_h$ of a sound emitting hole (through-holes 9) expressed by Equation 1. FIG. 10 shows the relationship between the minimum resonance frequency and the sound pressure. In FIG. 10, $f_0$ represents the minimum resonance frequency.

$$f_h = \frac{1}{2\pi}\sqrt{\frac{c^2 S_p^2}{V_p V_c}} \qquad \text{[Math. 1]}$$

In Equation 1, c represents a sound velocity, $V_c$ represents a volume of a space connected to the sound emitting hole, $V_p$ represents an equivalent volume of the sound emitting hole (including open end correction), and $S_n$ represents an equivalent cross-sectional area of the sound emitting hole.

In FIG. 9(*b*), openings 23 of the cabinet 21 are provided on the side where the diaphragm 4 of the speaker device 10 is provided. The openings 23 are provided in a portion of the cabinet 21, which portion partitions the space in which the front surface of the diaphragm 4 is exposed. On the other hand, the through-holes 9 are provided in a portion of the side wall of the yoke 3, which portion faces the inside of the cabinet 21. Therefore, the sound passing through the through-holes 9 is emitted to the inside of the cabinet 21. In addition, the through-holes 9 are provided only in the side surface of the yoke 3. Therefore, even when the speaker device 10 is disposed on the rear surface of the image display device via the cushioning material 22, the through-holes 9 are not closed, and the bass reproduction ability of the speaker device 10 is not inhibited. Therefore, the thickness of the entire cabinet 21 can be reduced.

Although the cabinet 21 serves as a part of a casing of the mobile information terminal, the cabinet 21 may be configured separately from the casing.

Specifically, the cushioning material 22 may be an elastomer such as rubber or urethane, or a resin. Although the cushioning material 22 is used as means for tightly adhering the speaker device 10 to the cabinet 21 by its repelling force, a force for tightly adhering the speaker device 10 to the cabinet 21 may be applied by using electrical connecting means such as a spring terminal.

Embodiment 7

Figure 11:
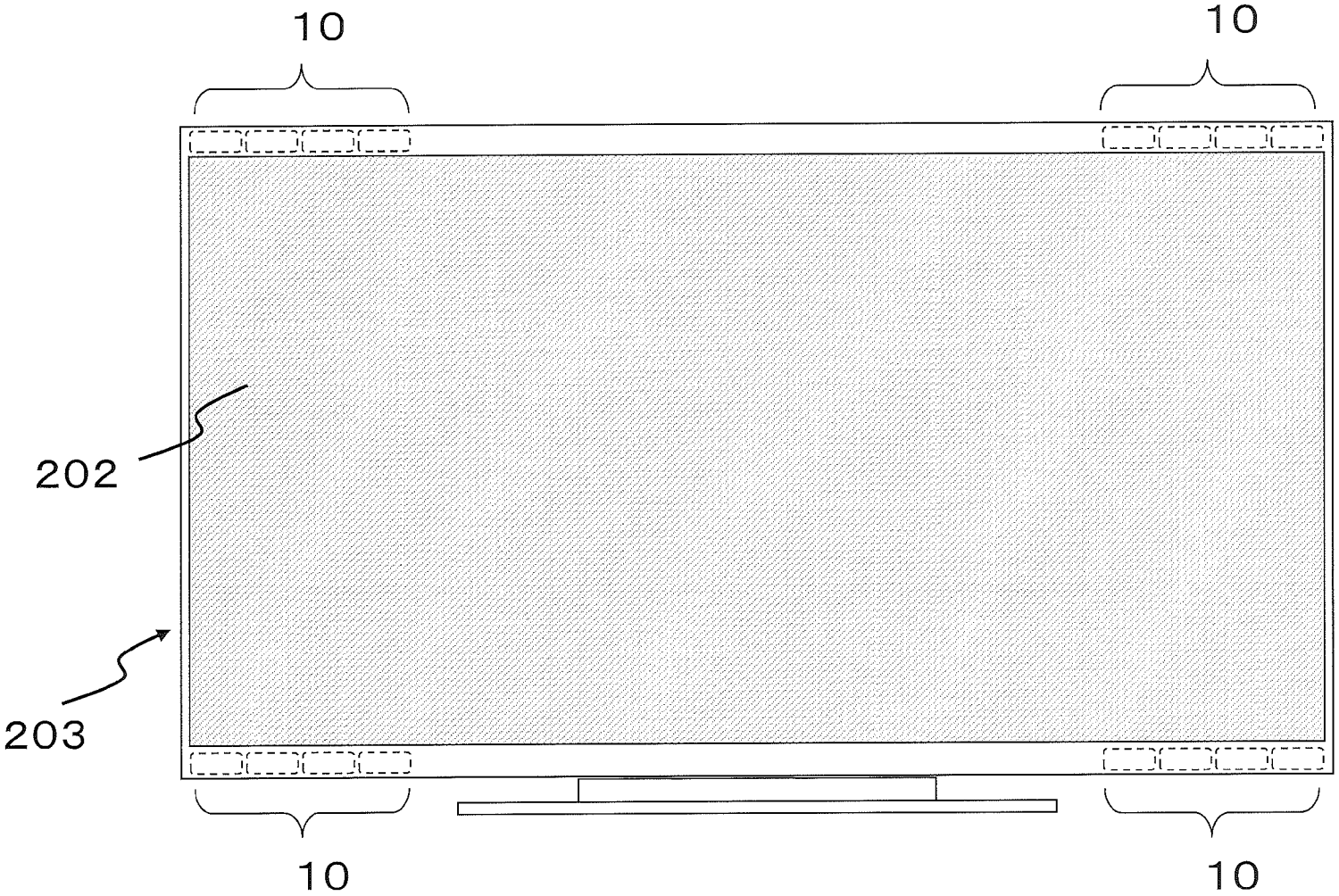
FIG. 11 is a front view of an image display device according to Embodiment 7.

FIG. 11 shows an image display device 203 (an example of audio visual equipment) according to Embodiment 7. Specifically, the image display device 203 is a PC or a flat-screen television. In FIG. 11, reference numeral 203 denotes an image display device, reference numeral 202 denotes a screen, and reference numeral 10 denotes a speaker device. The speaker device 10 is selected from among the speaker devices according to Embodiments 1 to 5 and the speaker devices derived from them. Some of these speaker devices may be combined. The speaker device 10, together with a closed type cabinet or a bass-reflex type cabinet, may be mounted to the image display device 203. Alternatively, the speaker device 10 may be mounted as an open type to the image display device 203 without using a cabinet. In FIG. 11, the speaker device 10 is disposed at sixteen locations, but the number of the speaker devices 10 may be any number as long as the number is one or more. With a single speaker device 10, the apparatus becomes monophonic; with two speaker devices 10, the apparatus becomes stereophonic; and with two or more speaker devices 10 (when linearly arrayed), the apparatus can be used for acoustic field control or for HRTF.

Even with an apparatus having a limited volume for mounting, such as the image display device, when the speaker device 10 is mounted to the image display device 203, reproduction is stably enabled in a wide frequency range. Regarding the mount direction of the speaker device 10, when being mounted with respect to a sound hole provided on a housing, the diaphragm may be directed toward the sound hole side or the through-hole 9 may be directed toward the sound hole side.

The image display device 203 is often designed such that the width of an outer frame provided around the screen 202 is reduced as much as possible. In this case, when the sound hole of the speaker device 10 is provided at the rear surface of the image display device 203, the sound quality is degraded. Therefore, the sound hole is desirably provided at the front surface of the image display device 203. In this case, the speaker device 10 needs to be mounted to the narrow outer frame. As described for Embodiments 1 to 5, since the thinner and slimmer speaker device 10 can be realized as compared with the conventional art, the image display device 203 can be designed so as to have the narrower outer frame. Accordingly, it is possible to realize the image display device 203 having both good design and high sound quality.

Embodiment 8

Figure 12:
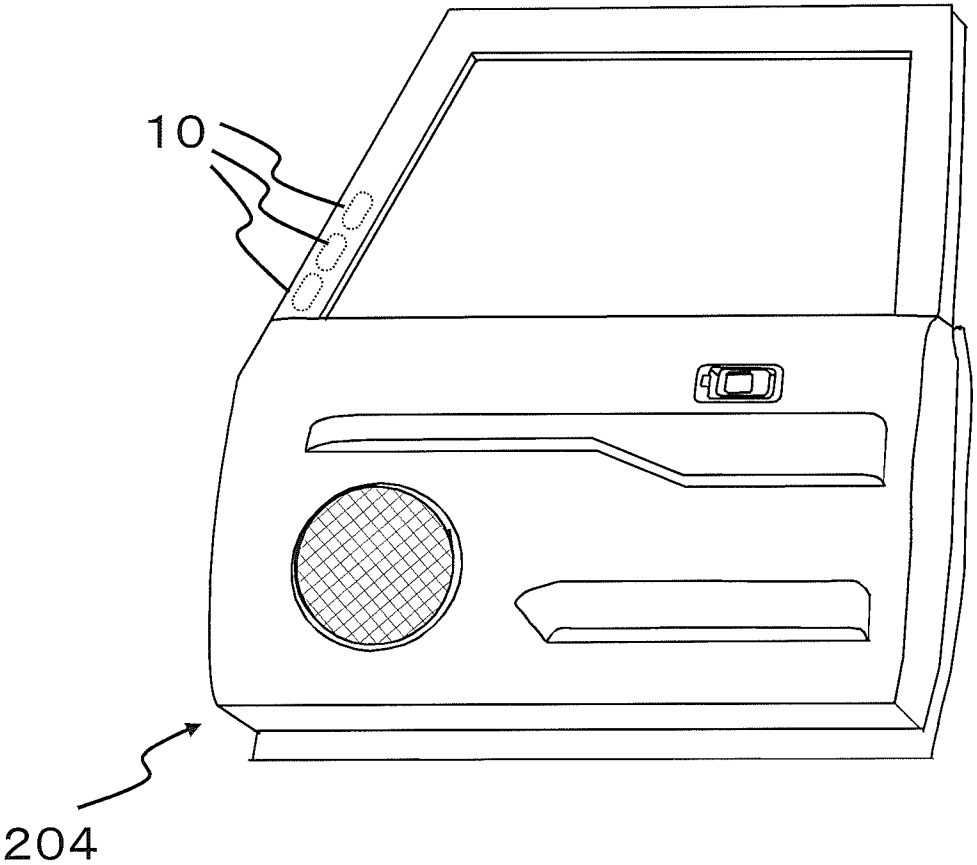
FIG. 12 is a diagram showing a mounted state of an in-vehicle speaker according to Embodiment 8.

FIG. 12 is a diagram showing a mounted state of an in-vehicle speaker according to Embodiment 8. In FIG. 12, reference numeral 204 denotes a door of an automobile, and reference character 10 denotes a speaker device selected from among the speaker devices according to Embodiments 1 to 5. The speaker device 10, together with a closed type cabinet or a bass-reflex type cabinet, may be mounted to the door 204 of the automobile. Alternatively, the speaker device 10 may be mounted as an open type to the door 204 without using a cabinet. In FIG. 12, the speaker device 10 is disposed at three locations, but the number of the speaker devices 10 may be any number as long as the number of the speaker devices 10 is one or more. In addition, FIG. 12 illustrates the example where the speaker device 10 is mounted to the door 204 of the automobile, but the speaker device 10 may be mounted to a location other than a door, such as a dashboard, a pillar, a sheet, a headrest, and a ceiling of an automobile. Moreover, the speaker device 10 may be mounted to various vehicles other than an automobile, such as a train, a monorail vehicle, a linear motor car, an airplane, and a ship.

Hitherto, a large-size speaker has been required to realize reproduction in a wide frequency range, particularly, reproduction of bass. Since the speaker device 10 using the magnetic fluid 7 according to the present embodiment can realize a speaker that is compact but can reproduce bass sound, it is possible to realize the same acoustic characteristics as those of a conventional one with the speaker smaller in size or weight than the conventional one. This leads to size reduction or weight reduction of the entirety of a vehicle. Further, improvement of comfort due to an enlarged interior space and improvement of fuel consumption due to size reduction or weight reduction of the vehicle body are possible.

Regarding the mount direction of the speaker device 10, when being mounted with respect to a sound hole provided on a housing of the door of the automobile, the diaphragm may be directed toward the sound hole side or the through-hole 9 may be directed toward the sound hole side.

Embodiment 9

Figure 13:
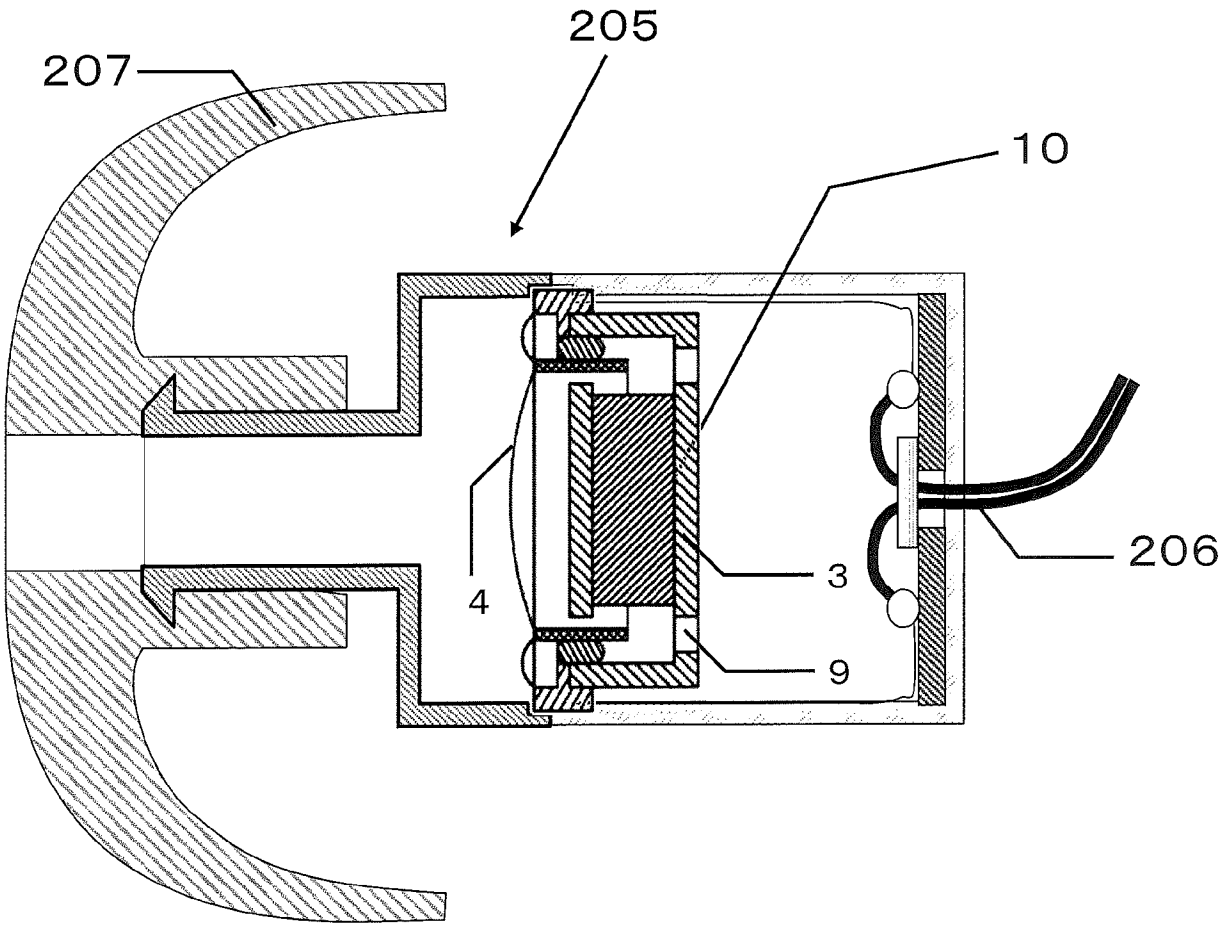
FIG. 13 is a structural cross-sectional view of an inner earphone according to Embodiment 9.
Figure 14:
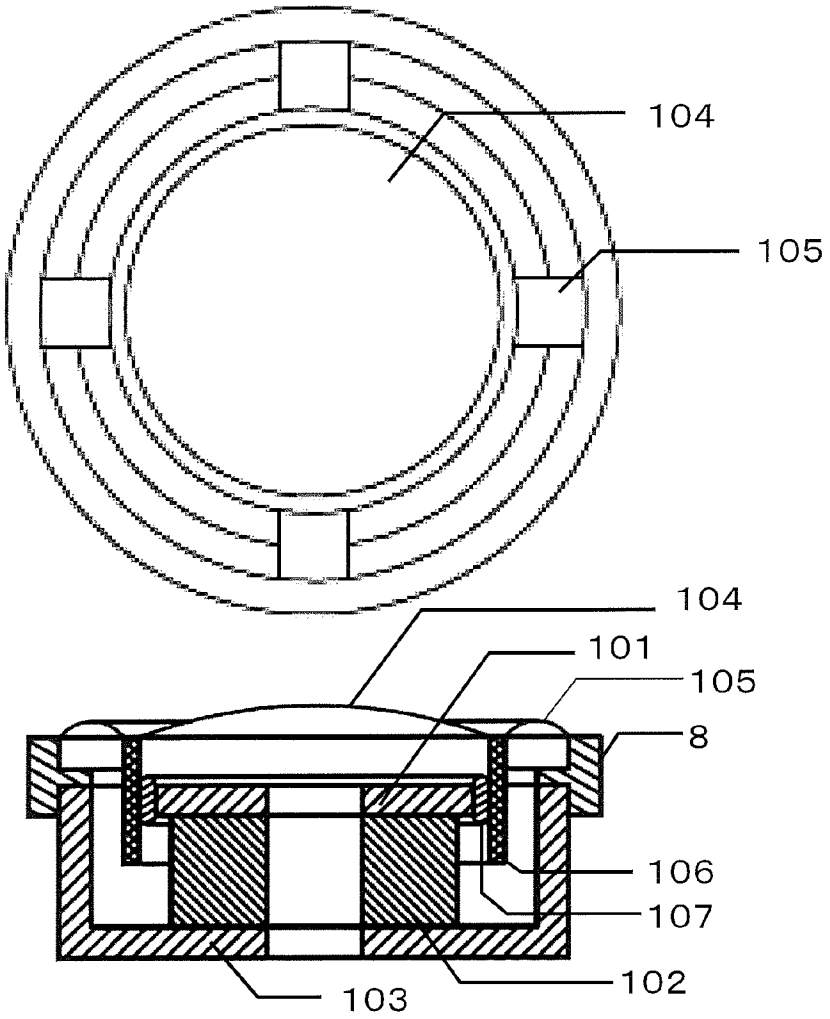
PRIOR ART Fig.14
FIG. 14 shows a top view and a structural cross-sectional view of a conventional speaker.

FIG. 13 is a diagram showing a mounted state of a speaker device 10 according to Embodiment 9. In FIG. 13, reference numeral 205 denotes an inner earphone, reference numeral 206 denotes a code of the earphone, and reference numeral 207 denotes an ear chip. Reference numeral 10 denotes a speaker device selected from among the speaker devices according to Embodiments 1 to 5.

By the way, conventionally, a speaker device (receiver) used in an inner earphone has been desired to have a small diameter in order to improve wearing sensation. In order to realize a speaker device having a small diameter, a small magnet with a hole has been needed. However, it is difficult to manufacture such a magnet. In contrast, when the above-mentioned speaker device is mounted in an inner phone, the diameter of the speaker device is not restricted by the magnet. Therefore, it is possible to provide a compact inner earphone capable of reproducing richer bass sound than ever. Regarding the mount direction of the speaker device 10, when being mounted with respect to a sound hole provided on a housing of the inner earphone, the diaphragm 4 may be directed toward the sound hole side or the through-hole 9 may be directed toward the sound hole side.

The ear chip 207 shown in FIG. 12 is a closed type ear chip. However, an open-type ear chip may be used in which an air hole is provided in an umbrella portion of the ear chip such that air can flow from the inside of an earhole through the air hole of the ear chip. The open-type ear chip prevents the earhole from being stuffy.

Although in Embodiment 9 the speaker device 10 is applied to an inner earphone, the speaker device 10 may be applied to a head set, a head phone, or an hearing aid.

INDUSTRIAL APPLICABILITY

A speaker device according to the present invention is thin or slim, and yet capable of reproducing sound in a wide frequency range, and capable of operating stably. Therefore, the speaker device is solely useful as a compact speaker with good sound quality, or the like. Further, in equipment to which a speaker is mounted, the speaker device is useful as a device for realizing downsizing and good sound quality, or the like.

DESCRIPTION OF THE REFERENCE CHARACTERS

1 plate
2 magnet
3 yoke
4 diaphragm
5 suspension (edge)
6 voice coil
7 magnetic fluid
8 frame
9 through-hole
10 speaker device
15 gas for communication
11 voice coil lead wire
110 yoke
111 magnet
112 plate
114 suspension (edge)
115 frame
116 voice coil
117 magnetic fluid
201 mobile information terminal apparatus
203 image display device
204 door of automobile
205 inner earphone

The invention claimed is:

1. A speaker device, comprising:

a magnetic circuit including: a plate; a magnet having a surface fixed to one surface of the plate, and having no through-hole; and a yoke fixed to a surface of the magnet opposite to the surface fixed to the plate, the yoke forming a magnetic gap between itself and an outer peripheral surface of the plate;

a voice coil disposed in the magnetic gap;

a diaphragm directly or indirectly fixed to the voice coil;

a supporting part configured to support the diaphragm; and a magnetic fluid disposed in at least a space between an outer peripheral surface of the voice coil and an inner peripheral surface of the yoke, wherein a rear surface side space between a rear surface of the diaphragm and a front surface of the plate communicates with a space outside the speaker device through a gap for communication which is formed in at least a part, in a peripheral direction of the voice coil, of a space between the outer peripheral surface of the plate and an inner peripheral surface of the voice coil, a radius of curvature of a corner portion in the inner peripheral surface of the yoke is 0.5 mm or more, the voice coil has a shape selected from a circular shape, a track shape, an oval shape, and a shape including a plurality of linear segments and a plurality of curved segments connecting the linear segments with each other, and a distance between the inner peripheral surface of the voice coil and the outer peripheral surface of the plate is not uniform in the peripheral direction of the voice coil.

2. The speaker device according to claim 1, wherein a through-hole is formed in the yoke outside a region where the magnet is fixed to the yoke, and the rear surface side space communicates with the space outside the speaker device through the gap for communication and the through-hole of the yoke.

3. The speaker device according to claim 1, wherein the outer peripheral surface of the plate has a pair of long-side side surfaces opposing each other in a short side direction of the plate, and a pair of short-side side surfaces opposing each other in a long side direction of the plate, and in the space between the outer peripheral surface of the plate and the inner peripheral surface of the voice coil, the magnetic fluid is disposed outside the long-side side surfaces, and the gap for communication is formed outside at least a part of the short-side side surfaces.

4. The speaker device according to claim 3, wherein portions of the inner peripheral surface of the voice coil, opposing the short-side side surfaces, are more distant from the outer peripheral surface of the plate than portions of the inner peripheral surface of the voice coil opposing the long-side side surfaces.

5. The speaker device according to claim 3, wherein projections projecting outward are formed at a part of the short-side side surfaces, and in the space between the outer peripheral surface of the plate and the inner peripheral surface of the voice coil, the magnetic fluid is disposed outside top end surfaces of the projections.

6. The speaker device according to claim 1, wherein the gap for communication is a plurality of gaps for communication, the plate has a planar shape having cutouts at four corners, and in the space between the outer peripheral surface of the plate and the inner peripheral surface of the voice coil, the cutouts form the gaps for communication, and the magnetic fluid is disposed at portions other than the cutouts.

7. The speaker device according to claim 3, wherein the supporting part supports the diaphragm over an entire periphery of the diaphragm.

8. The speaker device according to claim 1, wherein the supporting part includes a plurality of supporting members each supporting the diaphragm, and between the outer peripheral surface of the voice coil and the inner peripheral surface of the yoke, the magnetic fluid is disposed over an entire periphery in the peripheral direction of the voice coil.

9. The speaker device according to claim 2, wherein the through-hole is formed in a side surface of an outer peripheral portion of the yoke.

10. The speaker device according to claim 2, wherein a lead wire drawn from the voice coil passes through the through-hole.

11. The speaker device according to claim 2, wherein the yoke includes a plurality of the through-hole, and the plurality of the through-holes are arranged at equal angular intervals on a virtual circle concentric with a centroid axis of the voice coil parallel to a vibration direction of the diaphragm.

12. An audio visual equipment including the speaker device according to claim 1.

13. A mobile information processing apparatus including the speaker device according to claim 1.

14. A vehicle including the speaker device according to claim 1.

15. An earphone including the speaker device according to claim 1.

16. The speaker device according to claim 1, wherein the magnetic fluid is disposed only in the space between the outer peripheral surface of the voice coil and the inner peripheral surface of the yoke, and no magnetic fluid is disposed in the space between the outer peripheral surface of the plate and the inner peripheral surface of the voice coil.

17. A speaker device, comprising:

a magnetic circuit including: a plate; a magnet having a surface fixed to one surface of the plate, and having no through-hole; and a yoke fixed to a surface of the magnet opposite to the surface fixed to the plate, the yoke forming a magnetic gap between itself and an outer peripheral surface of the plate;

a voice coil disposed in the magnetic gap;

a diaphragm directly or indirectly fixed to the voice coil;

a supporting part configured to support the diaphragm; and a magnetic fluid disposed in at least a space between an outer peripheral surface of the voice coil and an inner peripheral surface of the yoke, wherein a rear surface side space between a rear surface of the diaphragm and a front surface of the plate communicates with a space outside the speaker device through a gap for communication which is formed in at least a part, in a peripheral direction of the voice coil, of a space between the outer peripheral surface of the plate and an inner peripheral surface of the voice coil, the outer peripheral surface of the plate has a pair of long-side side surfaces opposing each other in a short side direction of the plate, and a pair of short-side side surfaces opposing each other in a long side direction of the plate, in the space between the outer peripheral surface of the plate and the inner peripheral surface of the voice coil, the magnetic fluid is disposed outside the long-side side surfaces, and the gap for communication is formed outside at least a part of the short-side side surfaces, and portions of the inner peripheral surface of the voice coil, opposing the short-side side surfaces, are more distant from the outer peripheral surface of the plate than portions of the inner peripheral surface of the voice coil opposing the long-side surfaces.

18. A speaker device, comprising:

a magnetic circuit including: a plate; a magnet having a surface fixed to one surface of the plate, and having no through-hole; and a yoke fixed to a surface of the magnet opposite to the surface fixed to the plate, the yoke forming a magnetic gap between itself and an outer peripheral surface of the plate;

a voice coil disposed in the magnetic gap;

a diaphragm directly or indirectly fixed to the voice coil;

a supporting part configured to support the diaphragm; and a magnetic fluid, wherein a rear surface side space between a rear surface of the diaphragm and a front surface of the plate communicates with a space outside the speaker device through a gap for communication which is formed in at least a part, in a peripheral direction of the voice coil, of a space between the outer peripheral surface of the plate and an inner peripheral surface of the voice coil, the outer peripheral surface of the plate has a pair of long-side side surfaces opposing each other in a short side direction of the plate, and a pair of short-side side surfaces opposing each other in a long side direction of the plate, in the space between the outer peripheral surface of the plate and the inner peripheral surface of the voice coil, the magnetic fluid is disposed outside the long-side side surfaces, and the gap for communication is formed outside at least a part of the short-side side surfaces, projections projecting outward are formed at a part of the short-side side surfaces, and in the space between the outer peripheral surface of the plate and the inner peripheral surface of the voice coil, the magnetic fluid is disposed outside top end surface of the projections.

19. A speaker device, comprising:

a magnetic circuit including: a plate; a magnet having a surface fixed to one surface of the plate, and having no through-hole; and a yoke fixed to a surface of the magnet opposite to the surface fixed to the plate, the yoke forming a magnetic gap between itself and an outer peripheral surface of the plate;

a voice coil disposed in the magnetic gap;

a diaphragm directly or indirectly fixed to the voice coil;

a supporting part configured to support the diaphragm; and a magnetic fluid, wherein a rear surface side space between a rear surface of the diaphragm and a front surface of the plate communicates with a space outside the speaker device through gaps for communication which are formed in at least a part, in a peripheral direction of the voice coil, of a space between the outer peripheral surface of the plate and an inner peripheral surface of the voice coil, the plate has a planar shape with cutouts at four corners, and in the space between the outer peripheral surface of the plate and the inner peripheral surface of the voice coil, the cutouts form the gaps for communication, and the magnetic fluid is disposed at portions other than the cutouts.

* * * * *